US010456002B2

(12) United States Patent
Amaral et al.

(10) Patent No.: US 10,456,002 B2
(45) Date of Patent: Oct. 29, 2019

(54) CLEANING BIN FOR CLEANING ROBOT

(71) Applicant: iRobot Corporation, Bedford, MA (US)

(72) Inventors: Erik Amaral, Lexington, MA (US); Timothy R. Ohm, Grover Beach, CA (US); Nicholas Moretto, Glen Cove, NY (US)

(73) Assignee: iRobot Corporation, Bedford, MA (US)

( * ) Notice: Subject to any disclaimer, the term of this patent is extended or adjusted under 35 U.S.C. 154(b) by 337 days.

(21) Appl. No.: 15/388,776

(22) Filed: Dec. 22, 2016

(65) Prior Publication Data

US 2018/0177367 A1 Jun. 28, 2018

(51) Int. Cl.

| | |
|---|---|
| ***A47L 9/16*** | (2006.01) |
| ***A47L 9/04*** | (2006.01) |
| ***A47L 9/28*** | (2006.01) |

(52) U.S. Cl.

CPC ..... *A47L 9/1683* (2013.01); *A47L 9/0477* (2013.01)

(58) Field of Classification Search

None

See application file for complete search history.

(56) References Cited

U.S. PATENT DOCUMENTS

| | | | |
|---|---|---|---|
| 5,135,552 A | 8/1992 | Weistra | |
| 5,440,216 A | 8/1995 | Kim | |
| 6,168,641 B1 * | 1/2001 | Tuvin | A47L 5/362 55/337 |
| 6,389,329 B1 | 5/2002 | Colens | |
| 6,532,404 B2 | 3/2003 | Colens | |
| 6,594,844 B2 | 7/2003 | Jones | |
| 6,690,134 B1 | 2/2004 | Jones et al. | |
| 6,781,338 B2 | 8/2004 | Jones et al. | |

(Continued)

FOREIGN PATENT DOCUMENTS

| | | |
|---|---|---|
| JP | 2003-501120 | 1/2003 |
| WO | 2008141131 | 11/2008 |
| WO | 2016100878 | 6/2016 |

OTHER PUBLICATIONS

Howdymart.com [online]. "Haier WRC-680 Wireless Self-recharge UV Dust-mite Killer Robot Vacuum Floor Mopping with 200ml Built-in Reservoir," [retrieved on Nov. 22, 2016]. Retrieved from the Internet: URL <http://howdymart.com/home-maker/vacuums-floor-care/haier-wrc-680g-wireless-self-recharge-uv-dust-mite-killer-robot-vacuum-floor-mopping-with-200ml-built-in-reservoir.html>, 26 pages.

(Continued)

*Primary Examiner* — Joseph J Hail
*Assistant Examiner* — Brian D Keller
(74) *Attorney, Agent, or Firm* — Fish & Richardson P.C.

(57) ABSTRACT

A cleaning bin mountable to an autonomous cleaning robot operable to receive debris from a floor surface includes a debris compartment to receive a first portion of debris separated from the airflow and a particulate compartment to receive a second portion of debris separated from the airflow. The cleaning bin also includes a debris separation cone having an inner conduit defining an upper opening and lower opening. The upper opening receives the airflow from the air channel. The inner conduit tapers from the upper opening to the lower opening such that the airflow forms a cyclone within the inner conduit.

23 Claims, 11 Drawing Sheets

(56) References Cited

U.S. PATENT DOCUMENTS

| | | | |
|---|---|---|---|
| 6,809,490 | B2 | 10/2004 | Jones et al. |
| 6,965,209 | B2 | 11/2005 | Jones et al. |
| 7,117,557 | B2 | 10/2006 | Bair et al. |
| 7,146,681 | B2 | 12/2006 | Wright et al. |
| 7,155,308 | B2 | 12/2006 | Jones |
| 7,173,391 | B2 | 2/2007 | Jones et al. |
| 7,196,487 | B2 | 3/2007 | Jones et al. |
| 7,388,343 | B2 | 6/2008 | Jones et al. |
| 7,389,156 | B2 | 6/2008 | Ziegler et al. |
| 7,448,113 | B2 | 11/2008 | Jones et al. |
| 7,571,511 | B2 | 8/2009 | Jones et al. |
| 7,636,982 | B2 | 12/2009 | Jones et al. |
| 7,749,294 | B2 | 7/2010 | Oh et al. |
| 7,761,954 | B2 | 7/2010 | Ziegler et al. |
| 8,001,652 | B2 | 8/2011 | Bair et al. |
| 9,005,324 | B2 | 4/2015 | Smith |
| 9,504,365 | B2 | 11/2016 | Kim et al. |
| 2002/0016649 | A1 | 2/2002 | Jones |
| 2002/0120364 | A1 | 8/2002 | Colens |
| 2003/0025472 | A1 | 2/2003 | Jones et al. |
| 2004/0020000 | A1 | 2/2004 | Jones |
| 2004/0049877 | A1 | 3/2004 | Jones et al. |
| 2004/0187457 | A1 | 9/2004 | Colens |
| 2004/0207355 | A1 | 10/2004 | Jones et al. |
| 2005/0067994 | A1 | 3/2005 | Jones et al. |
| 2005/0125940 | A1 | 6/2005 | McDowell |
| 2005/0204717 | A1 | 9/2005 | Colens |
| 2005/0251951 | A1* | 11/2005 | Oh ..... A47L 9/1625 15/353 |
| 2005/0252180 | A1 | 11/2005 | Oh et al. |
| 2007/0266508 | A1 | 11/2007 | Jones et al. |
| 2008/0140255 | A1 | 6/2008 | Ziegler et al. |
| 2008/0155768 | A1 | 7/2008 | Ziegler et al. |
| 2008/0155947 | A1 | 7/2008 | Oh et al. |
| 2008/0201895 | A1* | 8/2008 | Kim ..... A47L 9/106 15/319 |
| 2008/0307590 | A1 | 12/2008 | Jones et al. |
| 2010/0049365 | A1 | 2/2010 | Jones et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2013/0305483 | A1 | 11/2013 | Dyson et al. |
| 2014/0013538 | A1* | 1/2014 | Dyson ..... A47L 9/1625 15/353 |
| 2016/0183752 | A1 | 6/2016 | Morin et al. |
| 2016/0345791 | A1 | 12/2016 | Britain |

OTHER PUBLICATIONS

Howdymart.com [online]. "WRC-680G" [retrieved on Nov. 22, 2016]. Retrieved from the Internet: URL <http://howdymart.com/media/wysiwyg/appliances/Robot/Haier/WRC-680G/WRC-680G-24.jpg>, 1 page.

International Search Report in International Application No. PCT/US20126/068386, dated Mar. 2, 2017, 11 pages.

* cited by examiner

CLEANING BIN FOR CLEANING ROBOT

TECHNICAL FIELD

This specification relates to a cleaning bin for a cleaning robot, in particular, an autonomous cleaning robot.

BACKGROUND

Cleaning robots include mobile robots that autonomously perform cleaning tasks within an environment, e.g., a home. Many kinds of cleaning robots are autonomous to some degree and in different ways. The cleaning robots can autonomously navigate about the environment and ingest debris as they autonomously navigate the environment. The ingested debris are often stored in cleaning bins that can be manually removed from the cleaning robots so that debris can be emptied from the cleaning bins. In some cases, an autonomous cleaning robot may be designed to automatically dock with evacuation stations for the purpose of emptying its cleaning bin of ingested debris.

SUMMARY

In one aspect, a cleaning bin mountable to an autonomous cleaning robot operable to receive debris from a floor surface includes an inlet positioned between lateral sides of the cleaning bin defining an interior width of the cleaning bin. The cleaning bin further includes an outlet configured to connect to a vacuum assembly operable to direct an airflow from the inlet of the cleaning bin to the outlet of the cleaning bin and a debris compartment to receive a first portion of debris separated from the airflow. The cleaning bin also includes an air channel positioned above the debris compartment and defined by a top surface of the debris compartment tilted relative to an inner surface of a top wall of the cleaning bin. The air channel spans the interior width of the cleaning bin and receives the airflow from the debris compartment through the top surface of the debris compartment. The cleaning bin includes a particulate compartment to receive a second portion of debris separated from the airflow. The cleaning bin also includes a debris separation cone having an inner conduit defining an upper opening and lower opening. The upper opening receives the airflow from the air channel. The inner conduit tapers from the upper opening to the lower opening such that the airflow forms a cyclone within the inner conduit.

In another aspect, an autonomous cleaning robot includes a body, a drive operable to move the body across a floor surface, and a vacuum assembly carried in the body. The vacuum assembly is operable to generate an airflow to carry debris from the floor surface as the body moves across the floor surface. The robot further includes a cleaning bin mounted to the body. The cleaning bin includes an inlet, an outlet connected to the vacuum assembly such that the airflow containing the debris is directed from the inlet to the outlet, a debris compartment to receive a first portion of the debris separated from the airflow, a particulate compartment to receive a second portion of the debris separated from the airflow, and a debris separation cone configured to receive the airflow from the debris compartment to form a cyclone that separates the second portion of the debris from the airflow and directs the second portion of the debris toward the particulate compartment.

In some implementations, the inlet spans a length between 75% and 100% of the interior width of the cleaning bin.

In some implementations, the top surface of the debris compartment includes a first filter. In some cases, the first filter is sized to inhibit debris having a width between 100 and 500 microns from passing into the air channel. In some cases, a filtering surface of the first filter and a horizontal plane through the cleaning bin forms an angle between 5 and 45 degrees.

In some implementations, the top surface of the debris compartment and a longitudinal axis of the debris separation cone define an angle between 85 and 95 degrees. The top surface of the debris compartment, for example, slopes downward toward the debris separation cone.

In some implementations, the air channel spans a length between 95% and 100% of the interior width of the cleaning bin.

In some implementations, the cleaning bin includes an evacuation port configured to connect to another vacuum assembly operable to direct an airflow from the outlet to the evacuation port. The cleaning bin also includes, for example, a first flap covering an open area pneumatically connected the debris compartment and the particulate compartment. The first flap is, for example, configured to open when a pressure on a side of the first flap facing the debris compartment is less than a pressure on a side of the first flap facing the particulate compartment. In some cases, the cleaning bin includes a second flap covering an open area between the debris compartment and the particulate compartment. The open area covered by the first flap is, for example, larger than the open area covered by the second flap, and the first flap is positioned farther from the evacuation port than the second flap.

In some implementations, a longitudinal axis of the debris separation cone defines an angle with a vertical axis through the cleaning bin between 5 and 25 degrees such that the upper opening the debris separation cone is tilted away from the inlet of the cleaning bin.

In some implementations, the inner conduit is a conical structure defining a slope that forms an angle with a center axis of the conical structure, the angle being between 15 and 40 degrees.

In some implementations, a diameter of the upper opening of the inner conduit is between 20 and 40 millimeters, and a diameter of the lower opening of the inner conduit is between 5 and 20 millimeters.

In some implementations, the debris separation cone is a first debris separation cone, and the inner conduit of the first debris separation cone receives a first portion of the airflow. The cleaning bin includes, for example, a second debris separation cone adjacent the first debris separation cone. The second debris separation cone has, for example, an inner conduit defining an upper opening and lower opening. The upper opening receives, for example, a second portion of the airflow from the air channel. The inner conduit, for example, tapers from the upper opening to the lower opening such that the second portion of the airflow forms a cyclone within the inner conduit.

In some implementations, the debris separation cone is one of a set of debris separation cones arranged linearly and having coplanar longitudinal axes angled away from the inlet such that upper openings of the debris separation cones are tilted away from the inlet.

In some implementations, the top surface of the debris compartment includes a first filter, and the cleaning bin further includes a second filter positioned between the debris separation cone and the outlet.

In some implementations, the outlet spans the interior width of the cleaning bin.

In some implementations, the cleaning bin further includes an inlet duct pneumatically connected to the air channel and pneumatically connected to the inner conduit of the debris separation cone. The inlet duct includes, for example, a minimum width that is between 5% and 15% of a width of the inlet.

In some implementations, the cleaning bin further includes an outlet duct to direct the airflow from the inner conduit of the debris separation cone toward the outlet. The outlet duct is, for example, tapered toward the inner conduit of the debris separation cone.

In some implementations, the cleaning bin further includes a door defining a bottom surface of the debris compartment and a bottom surface of the particulate compartment. The door is, for example, configured to be manually opened to enable debris in both the debris compartment and the particulate compartment to be removed from the cleaning bin.

In some implementations, a maximum height of the cleaning bin is less than 80 millimeters.

In some implementations, the robot further includes a cleaning roller rotatably mounted to the body. The cleaning roller is, for example, configured to engage the debris to move the debris toward the inlet of the cleaning bin. The inlet of the cleaning bin, for example, spans a length between 60% and 100% of a length of the cleaning roller.

Advantages of the foregoing may include, but are not limited to, those described below and herein elsewhere. The cleaning bin can separate debris in multiple stages such that less debris reaches the filter positioned immediately before the vacuum assembly. In one regard, debris is less likely to reach the filter and is thus less likely to impede airflow through the filter. As a result, the overall amount of power drawn by the vacuum assembly to generate an airflow is less than the overall amount of power drawn by vacuum assemblies that do not separate most of the debris from the airflow prior to the airflow reaching the filter. In another respect, because less debris reaches the filter during a cleaning operation, the filter does not need to be cleaned or replaced as often. The robot can ingest a greater amount of debris before the filter needs to be cleaned or replaced.

Furthermore, the cleaning bin achieves multiple stages of debris separation in a relatively compact profile, e.g., a profile having a lower height. As a result, the cleaning bin is usable with autonomous cleaning robots having relatively compact profiles, e.g., profiles having lower heights relative to the floor surface. In this regard, the autonomous cleaning robot to which the cleaning bin is mounted can occupy a small amount of the space in the environment and be less obtrusive in the environment. The cleaning robot can also fit in smaller spaces, e.g., under furniture and other obstacles, because of its smaller profile. In some examples, the cleaning bin includes multiple debris separation cones that are linearly arranged rather than being positioned in a circular arrangement. The linear arrangement of the debris separation cones can allow the overall height of the cleaning bin to be smaller compared to heights of cleaning bins in which debris separation cones are circularly arranged.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
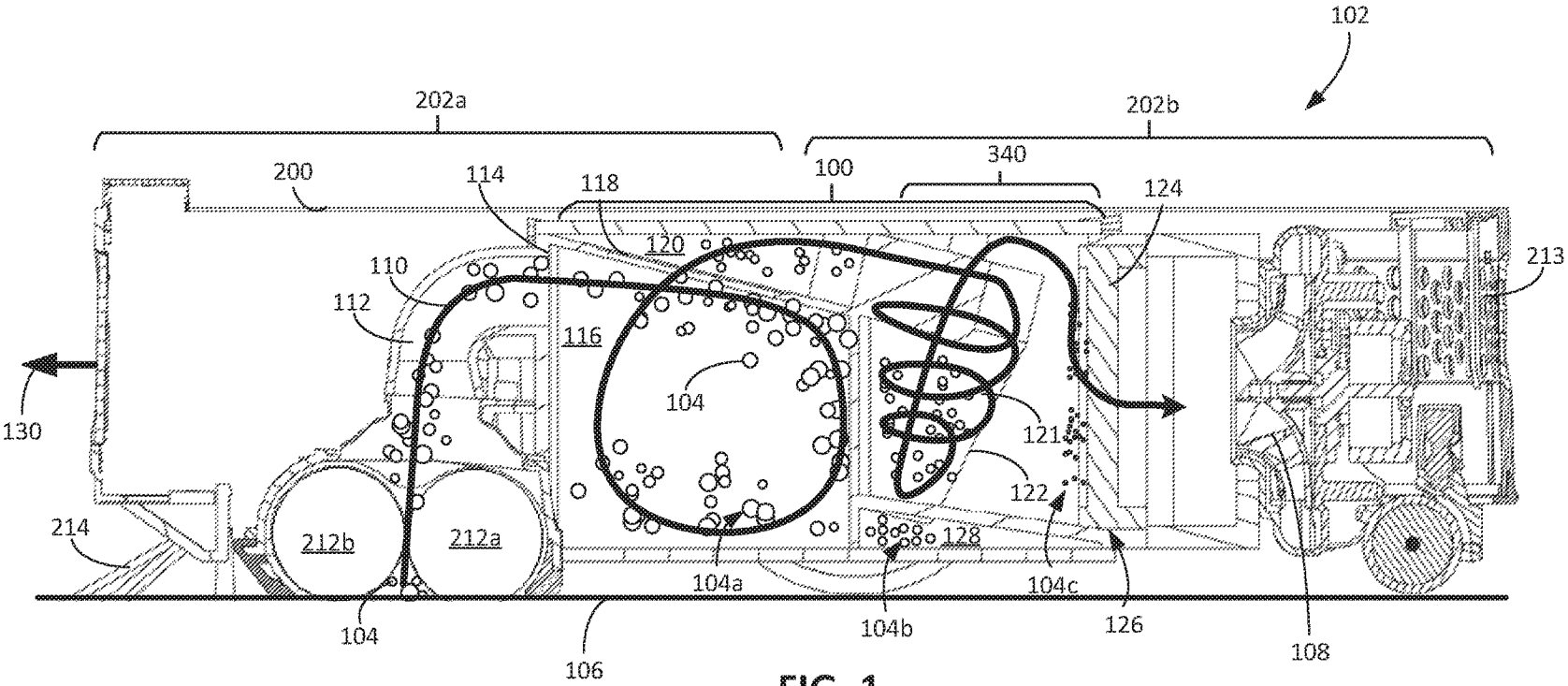
FIG. 1 is a right side cross-sectional view of an autonomous cleaning robot and a cleaning bin during a cleaning operation.

Referring to FIG. 1, a cleaning bin 100 is mounted to a cleaning robot 102. The cleaning bin 100 receives debris 104 ingested by the robot 102 during a cleaning operation of a floor surface 106. During the cleaning operation, a vacuum assembly 108 of the robot 102 generates an airflow 110 to lift debris 104 from the floor surface 106 toward the vacuum assembly 108. The airflow 110 draws the debris 104 from the floor surface 106 through a plenum 112. The airflow 110 is then directed through an inlet 114 of the cleaning bin 100, through a debris compartment 116, through a top surface 118 of the debris compartment 116, into an air channel 120, through a debris separation cone 122, and then through a filter 124 at an outlet 126 of the cleaning bin 100. As the airflow 110 containing the debris 104 travels through the cleaning bin 100, the debris 104 is separated from the airflow 110 and is deposited within the cleaning bin 100.

The cleaning bin 100 is a multi-compartment bin that includes multiple stages of debris separation to separate debris from the airflow 110 as the airflow 110 progresses through each stage during the cleaning operation. In one or more stages of debris separation, a portion 104*a* of the debris 104 is deposited within the debris compartment 116. In another stage of debris separation, another portion 104*b* of the debris 104 is deposited within a particulate compartment 128. In a further stage of debris separation, an additional portion 104*c* of the debris 104 is deposited on the filter 124.

In the stage in which the debris 104 is deposited within the particulate compartment 128, the debris separation cone 122 receives the airflow 110 and causes the airflow 110 to form a cyclone 121. The cyclone 121 facilitates separation of the portion 104*b* of the debris 104 contained within the airflow 110. The portion 104*b* in turn is deposited within the particulate compartment 128. The multiple stages of debris separation before the filter 124 can reduce the amount of debris 104 that reaches the filter 124. Because a smaller portion 104*c* of the debris 104 reaches the filter 124, the open area at the filter 124 available for the vacuum assembly 108 to generate the airflow 110 remains higher during cleaning operations. As a result, power requirements for the vacuum assembly 108 can be lower during cleaning operations, thereby improving overall energy efficiency of the vacuum assembly 108.

Figure 2:
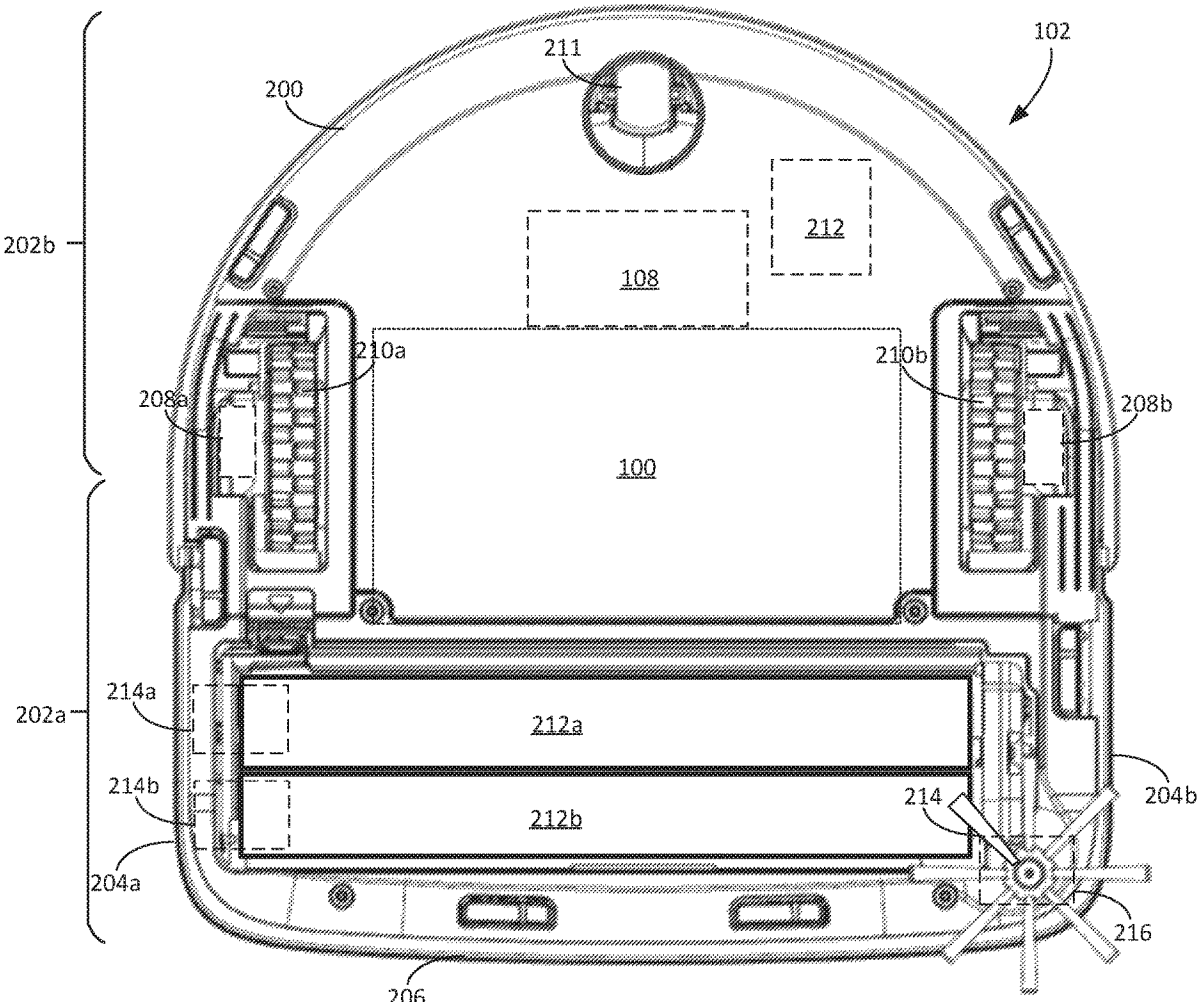
FIG. 2 is a bottom view of the autonomous cleaning robot of FIG. 1.

In some implementations, the cleaning robot 102 is an autonomous cleaning robot that autonomously traverses the floor surface 106 while ingesting debris from the floor surface 106. In the examples depicted in FIGS. 1 and 2, the robot 102 includes a body 200 movable across the floor surface 106. As shown in FIG. 2, in some implementations, the body 200 includes a front portion 202*a* that has a substantially rectangular shape and a rear portion 202*b* that has a substantially semicircular shape. The front portion 202*a* includes, for example, two lateral sides 204*a*, 204*b* that are substantially perpendicular to a front side 206 of the front portion 202*a*.

The robot 102 includes a drive system including actuators 208*a*, 208*b* operable with drive wheels 210*a*, 210*b*. The actuators 208*a*, 208*b* are mounted in the body 200 and are operably connected to the drive wheels 210*a*, 210*b*, which are rotatably mounted to the body 200. The drive wheels 210*a*, 210*b* support the body 200 above the floor surface 106. The robot 102 includes a controller 212 that operates the actuators 208*a*, 208*b* to autonomously navigate the robot 102 about the floor surface 106 during a cleaning operation. The actuators 208*a*, 208*b* are operable to drive the robot 102 in a forward drive direction 130 (shown in FIG. 1). In some implementations, the robot 102 includes a caster wheel 211 that supports the body 200 above the floor surface 106. The caster wheel 211, for example, supports the rear portion 202*b* of the body 200 above the floor surface 106, and the drive wheels 210*a*, 210*b* support the front portion 202*a* of the body 200 above the floor surface 106.

The vacuum assembly 108 is also carried within the body 200 of the robot 102, e.g., in the rear portion 202*b* of the body 200. The controller 212 operates the vacuum assembly 108 to generate the airflow 110 and enable the robot 102 to ingest the debris 104 during the cleaning operation. The robot 102 includes, for example, a vent 213 at the rear portion 202*b* of the body 200. The airflow 110 generated by the vacuum assembly 108 is exhausted through the vent 213 into an environment of the robot 102. In some implementations, rather than being exhausted by a vent at the rear portion 202*b* of the body, the airflow 110 generated by the vacuum assembly 108 is exhausted through a conduit connected to a cleaning head of the robot 102. The cleaning head includes, for example, one or more rollers that engage the floor surface 106 and sweep the debris 104 into the cleaning bin 100. The airflow 110 exhausted to the cleaning head can further improve pickup of debris from the floor surface 106 by increasing an amount of airflow proximate the cleaning head to agitate the debris 104 on the floor surface 106.

In some cases, the cleaning robot 102 is a self-contained robot that autonomously moves across the floor surface 106 to ingest debris. The cleaning robot 102, for example, carries a battery to power the vacuum assembly 108. The improved energy efficiency can reduce the required sizes of components of the cleaning robot 102, thereby reducing the overall size and/or height of the cleaning robot 102. For example, the improved energy efficiency of the vacuum assembly 108 can reduce the size of the vacuum assembly 108 required to ingest debris 104 from the floor surface 106. In turn, the size of the battery can also be smaller to meet the power requirements of the vacuum assembly 108.

In the example depicted in FIGS. 1 and 2, the cleaning head of the robot 102 includes a first roller 212*a* and a second roller 212*b*. The rollers 212*a*, 212*b* are positioned forward of the cleaning bin 100, which is positioned forward of the vacuum assembly 108. The rollers 212*a*, 212*b* are operably connected to actuators 214*a*, 214*b*, and are each rotatably mounted to the body 200. In particular, the rollers 212*a*, 212*b* are mounted to an underside of the front portion 202*a* of the body 200 so that the rollers 212*a*, 212*b* engage debris 104 on the floor surface 106. The rollers 212*a*, 212*b* are rotatable about axes parallel to the floor surface 106. The rollers 212*a*, 212*b* include, for example, brushes or flaps that engage the floor surface 106 to collect the debris 104 on the floor surface 106. The rollers 212*a*, 212*b* each have a length between, for example, 10 cm and 50 cm, e.g., between 10 cm and 30 cm, 20 cm and 40 cm, 30 cm and 50 cm. The rollers 212*a*, 212*b* span substantially the entire width of the front portion 202*a* between the lateral sides 204*a*, 204*b*.

During the cleaning operation, the controller 212 operates the actuators 214*a*, 214*b* to rotate the rollers 212*a*, 212*b* to engage the debris 104 on the floor surface 106 and move the debris 104 toward the plenum 112. The rollers 212*a*, 212*b*, for example, counter rotate relative to one another to cooperate in moving debris 104 toward the plenum 112, e.g., one roller rotates counterclockwise while the other rotates clockwise. The plenum 112 in turn guides the airflow 110 containing the debris 104 into the cleaning bin 100. As described herein, during the travel of airflow 110 through the cleaning bin 100 toward the vacuum assembly 108, the debris 104 is deposited in different compartments of the cleaning bin 100.

In some implementations, to sweep debris 104 toward the rollers 212*a*, 212*b*, the robot 102 includes a brush 214 that rotates about a non-horizontal axis, e.g., an axis forming an angle between 75 degrees and 90 degrees with the floor surface 106. The robot 102 includes an actuator 216 operably connected to the brush 214. The brush 214 extends beyond a perimeter of the body 200 such that the brush 214 is capable of engaging debris 104 on portions of the floor surface 106 that the rollers 212*a*, 212*b* typically cannot reach. During a cleaning operation, the controller 212 operates the actuator 216 to rotate the brush 214 to engage debris 104 that the rollers 212*a*, 212*b* cannot reach. In particular, the brush 214 is capable of engaging debris 104 near walls of the environment and brushing the debris 104 toward the rollers 212*a*, 212*b* to facilitate ingestion of the debris 104 by the robot 102.

Figure 3A:
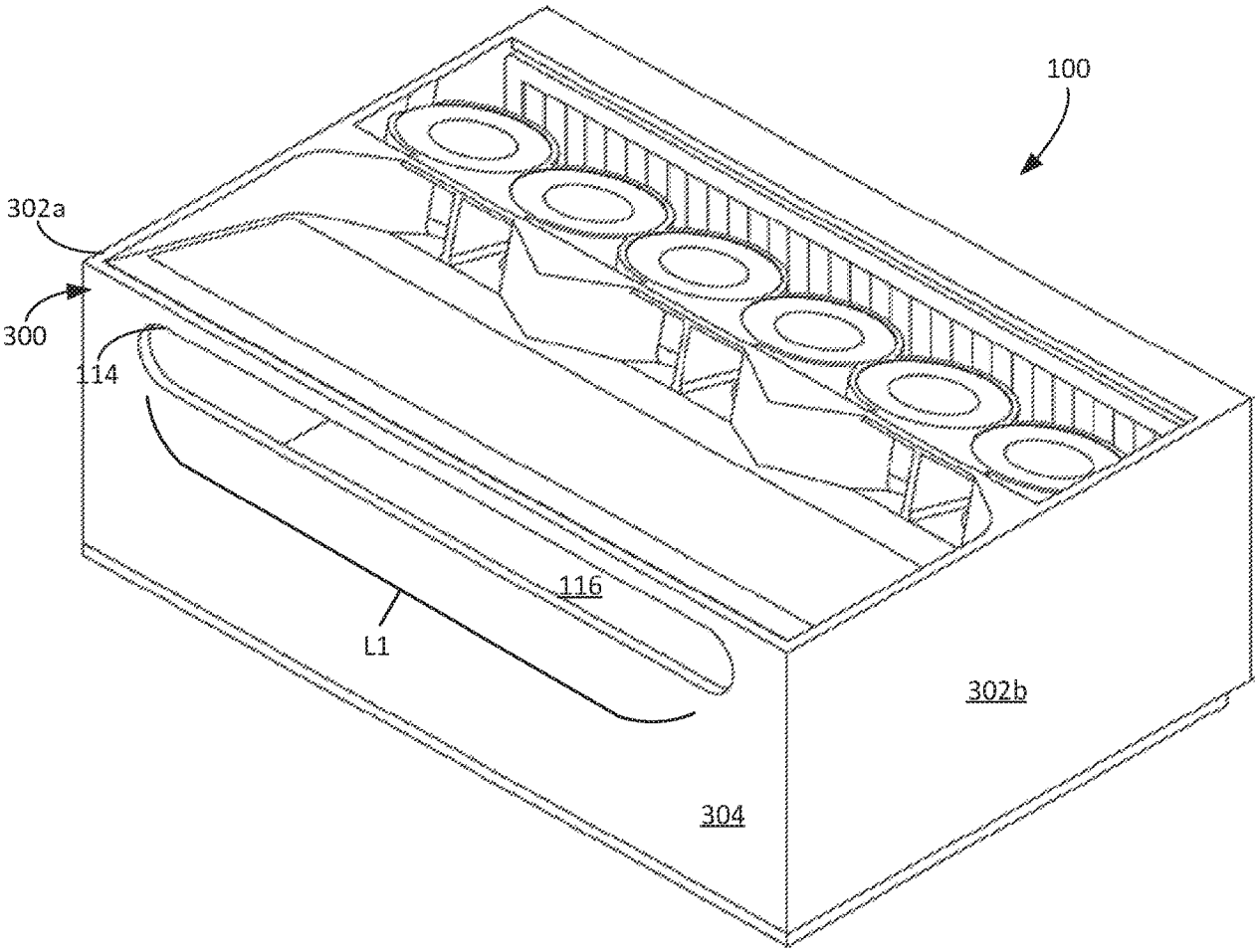
FIG. 3A is a top-front perspective view of a cleaning bin for the autonomous cleaning robot of FIG. 1.
Figure 3B:
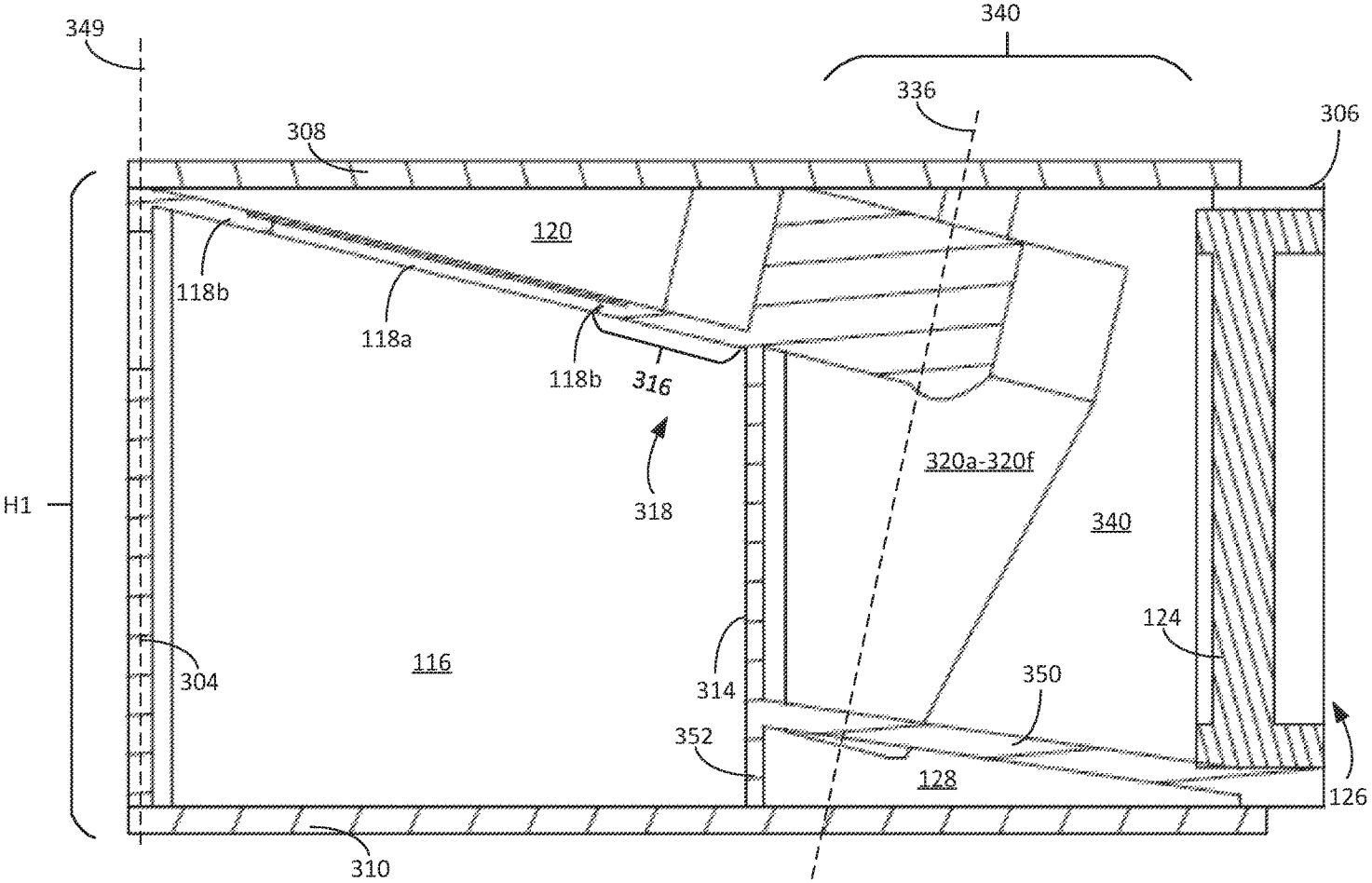
FIG. 3B is a right side cross-sectional view of the cleaning bin of FIG. 3A.
Figure 3C:
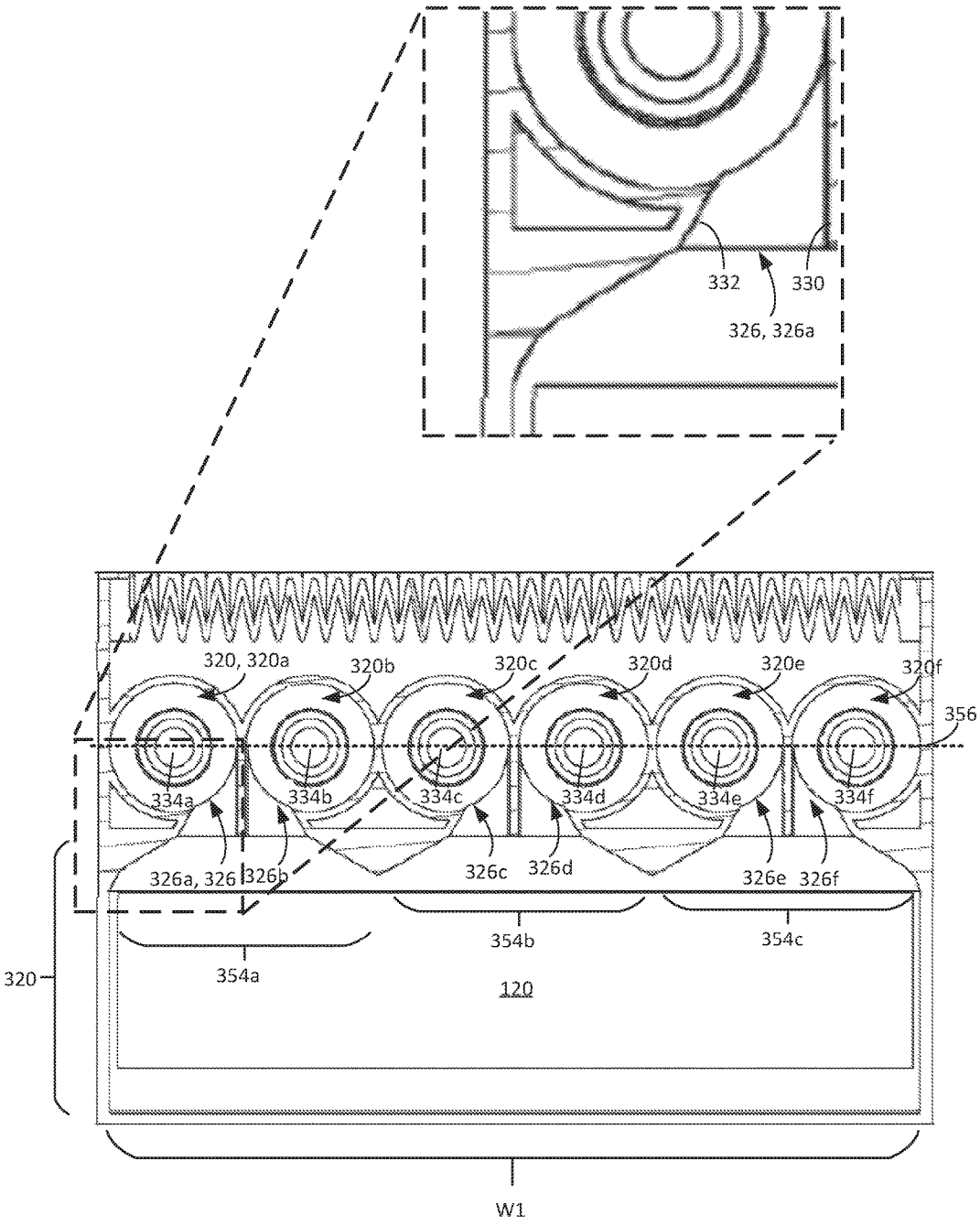
FIG. 3C is a top cutaway view of the cleaning bin of FIG. 3A with a top side of the cleaning bin removed.

When the debris 104 is ingested by the robot 102, the cleaning bin 100 stores the ingested debris 104 in multiple compartments. The cleaning bin 100 is mounted to the body 200 of the robot 102 during the cleaning operation so that the cleaning bin 100 receives debris 104 ingested by the robot 102 and so that the cleaning bin 100 is in pneumatic communication with the vacuum assembly 108. Referring to FIGS. 3A and 3B, the cleaning bin 100 includes a body 300 defining the inlet 114, the debris compartment 116, the air channel 120, the debris separation cone 122, and the outlet 126. The body 300 includes lateral sides 302*a*, 302*b*, a front side 304, a rear side 306, a top side 308, and a bottom side 310. As shown in FIG. 3C, the lateral sides 302*a*, 302*b* define an interior width W1 of the cleaning bin 100. The interior width W1 is, for example, between 15 cm and 45 cm, e.g., between 15 cm and 25 cm, 25 cm and 35 cm, 35 cm and 45 cm, etc. The interior width W1 is, for example, 65% to 100% of the length of the rollers 212*a*, 212*b*, e.g., 65% to 75%, 75% to 85%, 85% to 100% of the length of the rollers 212*a*, 212*b*.

In some implementations, the front side 304, the rear side 306, and the lateral sides 302*a*, 302*b* define a rectangular horizontal cross section of the cleaning bin 100. The geometry of the horizontal cross section can vary in other implementations. In some examples, a portion of the geometry of the cleaning bin 100 matches with a portion of the geometry of the robot 102. For example, if the robot 102 includes circular or semicircular geometry, in some cases, one of the sides the cleaning bin 100 tracks the circular or semicircular geometry of the robot 102. The side, for example, includes an arced portion such that the horizontal cross section of the cleaning bin 100 tracks the circular or semicircular geometry of the robot 102.

In some implementations, the lateral sides 302*a*, 302*b*, the top side 308, and the bottom side 310 define a rectangular vertical cross section of the cleaning bin 100. The geometry of the vertical cross section of the cleaning bin 100 can vary in other implementations. In some examples, the vertical cross section has an elliptical shape, a trapezoidal shape, a pentagonal shape, or other appropriate shape. The lateral sides 302*a*, 302*b*, in some cases, are parallel to one another, while in other cases, the lateral sides 302*a*, 302*b* extend along axes that intersect with one another. Similarly, in some cases, the top side 308 and the bottom side 310 are parallel to one another, while in other cases, the top side 308 and the bottom side 310 extend along axes that intersect with one another. In some cases, the lateral sides 302*a*, 302*b*, the top side 308, and/or the bottom side 310 include one or more curved portions.

As described herein, in addition to storing debris 104, the cleaning bin 100 includes multiple stages of debris separation to separate different sizes of debris from the airflow 110. As shown in FIG. 3B, despite having the functions of both debris storage and debris separation, the cleaning bin 100 can have a relatively small height H1. The height H1 of the cleaning bin 100 is, for example, between 50 mm and 100 mm, e.g., less than 100 mm, less than 80 mm, less than 60 mm. The height of the portion of the cleaning bin 100 between the inlet 114 and the outlet 126 is, for example, less than or equal to the height H1.

The inlet 114 of the cleaning bin 100 is an opening through the front side 304 of the cleaning bin 100. The inlet 114 is positioned between the lateral sides 302*a*, 302*b* of the cleaning bin 100. The inlet 114 is pneumatically connected to the plenum 112 and the debris compartment 116. In some implementations, a seal is positioned on an outer surface of the front side 304 of the cleaning bin 100 so that the cleaning bin 100 forms a sealed engagement with the body 200 of the robot 102 when the cleaning bin 100 is mounted in the body 200 of the robot 102. In this regard, the inlet 114 directs the airflow 110 containing the debris 104 from the plenum 112 into the debris compartment 116 during the cleaning operation.

The inlet 114 spans a length L1, for example, between 75% and 100% of the interior width W1 of the cleaning bin 100, e.g., 75% to 85%, 80% to 90%, 85% to 95% of the interior width W1. The inlet 114 spans, for example, 60% to 100% of the length of the rollers 212*a*, 212*b*, e.g., 60% to 70%, 70% to 80%, 80% to 90%, 90% and 100%, etc., of the length of the rollers 212*a*, 212*b*. Because the inlet 114 spans across substantially an entire length of the rollers 212*a*, 212*b*, the airflow 110 generated by the vacuum assembly 108 can draw the airflow 110 from along the entire length of the rollers 212*a*, 212*b*. As a result, the airflow 110 can facilitate ingestion of debris 104 at locations across the entire length of the rollers 212*a*, 212*b*.

The debris compartment 116 is defined by the front side 304, the bottom side 310, the lateral sides 302*a*, 302*b*, a rear surface 314 of the debris compartment 116, and the top surface 118 of the debris compartment 116. The debris compartment 116 stores larger debris ingested by the robot 102. The debris compartment 116 typically stores a majority of volume of the debris 104 ingested by the robot 102. In this regard, the debris compartment 116 has a volume between 25 and 75%, e.g., 25 to 50%, 40 to 60%, and 50% to 75%, etc., of the overall volume of the cleaning bin 100 defined by the lateral sides 302*a*, 302*b*, the front side 304, the rear side 306, the top side 308, and the bottom side 310.

From the perspective shown in FIG. 3B, the vertical cross section of the debris compartment 116 has a trapezoidal shape. In some cases, the rear surface 314 and the front surface of the debris compartment 116 are substantially parallel, e.g., forming an angle between 0 and 15 degrees with respect to one another. The front surface, for example, corresponds to an inner surface of the front side 304 of the cleaning bin 100. The top surface 118 of the debris compartment 116 is angled relative to the front side 304 defining the inlet 114. The top surface 118 of the debris compartment 116 is, for example angled relative to a direction of the airflow 110 into the debris compartment 116 and/or angled relative to a direction of the airflow 110 through the top surface 118 of the debris compartment 116. The top surface 118 and the direction of the airflow 110 into the debris compartment 116 forms an angle, for example, between 5 and 45 degrees, e.g., between 5 and 25 degrees, 15 and 35 degrees, 25 and 45 degrees. The top surface 118 of the debris compartment 116 is also angled relative to an interior surface of the top side 308 of the cleaning bin 100. In some examples, the top surface 118 is angled in a manner such that the airflow 110 travelling through the inlet 114 is directed horizontally toward the top surface 118. The top surface 118 and the front side 304, for example, form an acute angle, e.g., an angle less than 90 degrees. The top surface 118 is, for example, angled relative to a horizontal plane passing through the cleaning bin 100. The top surface 118 and the horizontal plane forms an angle between 5 and 45 degrees, e.g., between 5 and 25 degrees, 15 and 35 degrees, 25 and 45 degrees.

The top surface 118 includes a filtering surface 118*a* surrounded by a blocking surface 118*b*. The filtering surface 118*a* is a filter, such as a pre-filter or a screen that allows the airflow 110 to travel from the debris compartment 116 into the air channel 120. The filtering surface 118*a* is, in some cases, removable and washable. In some cases, the filtering surface 118*a* is disposable filter. The filtering surface 118*a* is, for example, a porous surface. The filtering surface 118*a* is sized to inhibit debris having a width between 100 and 500 microns from passing into the air channel 120. The filtering surface 118*a* is positioned along the top surface 118 such that horizontally directed debris 104 and airflow 110 from the inlet is directed toward the filtering surface 118*a* and into the air channel 120.

The blocking surface 118*b* is positioned relative to the filtering surface 118*a* and the inlet 114 to block the airflow 110 in certain portions of the debris compartment 116. The filtering surface 118*a* is positioned between a portion 316 of the blocking surface 118*b* and the inlet 114. The portion 316 of the blocking surface 118*b* is positioned between the filtering surface 118*a* and the rear surface 314 of the debris compartment 116. The portion 316 of the blocking surface 118*b* is, for example, a non-horizontal surface that inhibits the airflow 110 from entering into a dead zone 318 below the portion 316 of the blocking surface 118*b*. As a result, any of the debris 104 that enters the dead zone 318 is separated from the airflow 110. The debris 104 that enters the dead zone 318 is, for example, debris 104 that is too large to pass through the filtering surface 118*a*. While some of this debris 104 is stored within the debris compartment 116, in some cases, the debris 104 continues recirculating around the debris compartment 116 during the cleaning operation while the airflow 110 is being generated. The blocking surface 118*b* and the resulting dead zone 318 can prevent the debris 104 from impeding the airflow 110 through the filtering surface 118*a*.

The air channel 120 receives the airflow 110 from the debris compartment 116 through the filtering surface 118*a*, e.g., after the filtering surface 118*a* has separated a portion of the debris 104 from the airflow 110. The air channel 120 is positioned above the debris compartment 116 and defined by the top surface 118 of the debris compartment 116, the interior surface of the top side 308 of the cleaning bin 100, and the lateral sides 302*a*, 302*b* of the cleaning bin 100. A bottom surface of the air channel 120, for example, corresponds to the top surface 118 of the debris compartment 116. In some cases, the air channel 120 substantially spans an entire length of the interior width W1 of the cleaning bin 100, e.g., spans between 95% and 100% of the interior width W1 of the cleaning bin 100. The air channel 120 has, for example, a substantially triangular shape or trapezoidal shape. In particular, a vertical cross section of the air channel 120 has a substantially triangular shape. The bottom surface of the air channel 120 forms an angle with a top surface of the air channel 120 between, for example, 5 and 45 degrees, e.g., between 5 and 25 degrees, 15 and 35 degrees, 25 and 45 degrees, etc. The bottom surface of the air channel 120 slopes downward toward the debris separation cone 122.

Figure 4A:
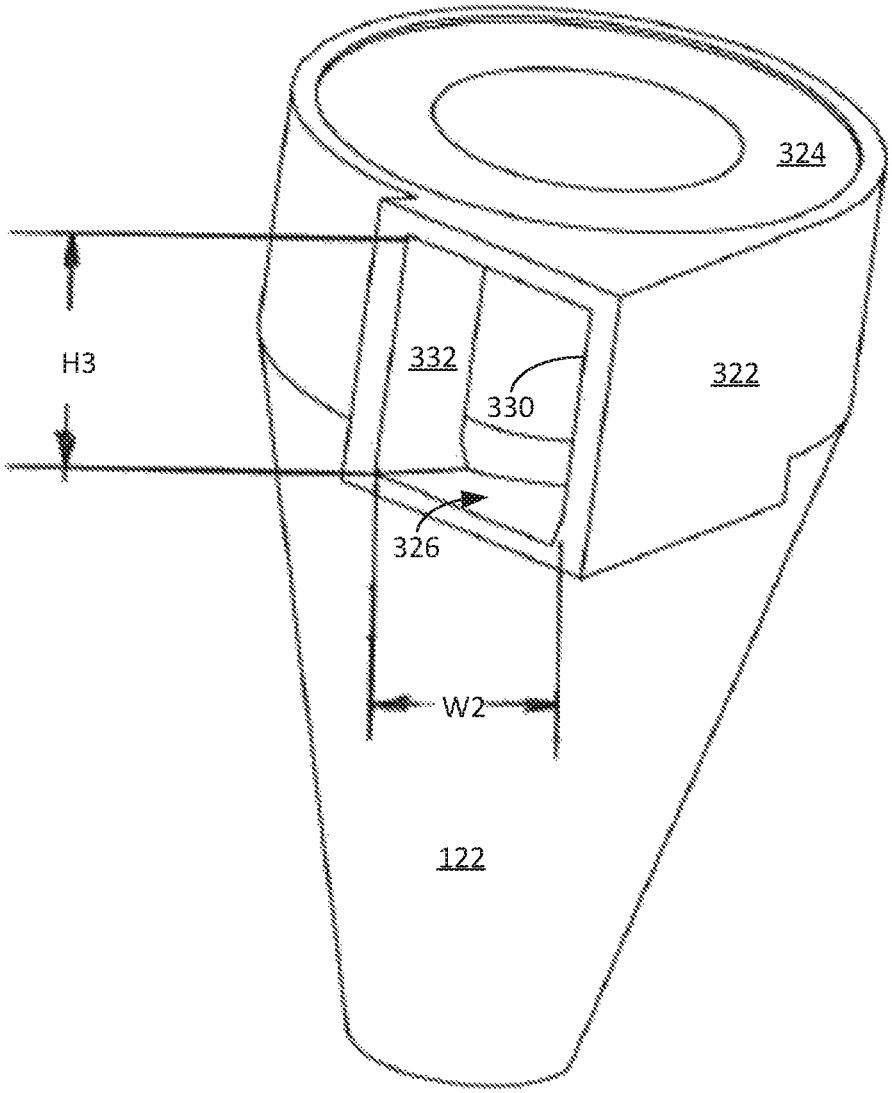
FIG. 4A is a front perspective view of a debris separator for the cleaning bin of FIG. 3A.

Referring also to FIG. 4A, the cleaning bin 100 includes a debris separator 320 including a housing 322, a vortex finder 324, and the debris separation cone 122. The housing 322 defines an inlet duct 326 to receive the airflow 110 from the air channel 120. In some examples, the bottom surface of the inlet duct 326 is parallel to the bottom surface of the air channel 120. The inlet duct 326 is pneumatically connected to the air channel 120 and pneumatically connected to an interior volume 328 of the debris separator 320 shown in FIG. 4B. The interior volume 328 of the debris separator 320 includes an upper inner conduit 328*a* defined by the housing 322 and the vortex finder 324. The interior volume 328 further includes a lower inner conduit 328*b* defined by the debris separation cone 122. The interior volume 328 is a continuous interior volume formed by the upper inner conduit 328*a* and the lower inner conduit 328*b*.

Figure 4C:
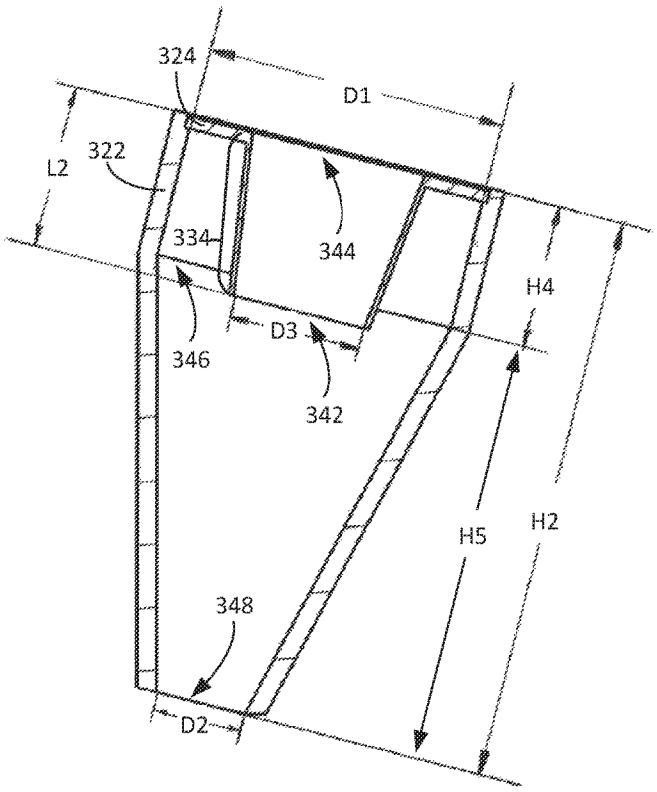
FIGS. 4B and 4C are rear cross-sectional views of the debris separator of FIG. 4A.

In some examples, as shown in FIG. 4C, an overall height H2 of the debris separator 320 is between 40 mm and 80 mm, e.g., between 40 and 60 mm, 50 and 70 mm, 60 and 80 mm. The overall height H2 of the debris separator 320 is, for example, between 50% and 90% of the overall height of the cleaning bin 100, e.g., between 50% and 60%, 60% and 70%, 70% and 80%, 80% and 90%, etc., of the overall height of the cleaning bin 100.

In some examples, a minimum cross-sectional area of the inlet duct 326 is between 50 $mm^2$ and 300 $mm^2$ or larger, e.g., between 50 and 200 $mm^2$, 200 and 300 $mm^2$, or larger, etc. In a further example, a minimum height H3 of the inlet duct 326 is between 10 mm and 25 mm, e.g., between 10 and 20 mm, 15 and 25 mm, etc. In some cases, the minimum height H3 of the inlet duct 326 is a percent of the overall height H2 of the debris separator 320. The minimum height H3 is, for example, 15% to 40% of the overall height H2 of the debris separator 320, e.g., 15% to 30%, 20% to 35%, 25% to 40% of the overall height H2.

The inlet duct 326 is pneumatically connected to the upper inner conduit 328*a* defined by the housing 322. The housing 322 is secured to the debris separation cone 122 and to the vortex finder 324. The housing 322 receives the vortex finder 324 such that an outlet duct 334 of the vortex finder 324 extends through the upper inner conduit 328*a*. As shown in FIG. 4C, in some examples, the housing 322 has a cylindrical shape, and the upper inner conduit 328*a* also has a cylindrical shape. In some examples, the housing 322 has a height H4 between 10 mm and 30 mm, e.g., between 10 and 20 mm, 15 and 25 mm, 20 and 30 mm, etc.

As shown in FIGS. 3C and 4A, the inlet duct 326 of the debris separator 320 includes a first vane 330 tangential to a surface of the upper inner conduit 328*a* and a second vane 332 angled relative to the first vane 330. In some cases, the height H4 is a percent of the overall height H2 of the debris separator 320. The height H4 is, for example 15% to 40% of the overall height H2 of the debris separator 320, e.g., 15% to 30%, 20% to 35%, 25% to 40% of the overall height H2. In some examples, the height H4 of the housing 322 is substantially equal to the minimum height H3 of the inlet duct 326. In some implementations, a height of the upper inner conduit 328*a* is equal to the height of the housing 322 minus a wall thickness of the vortex finder 324. In some examples, a diameter D1 of the upper inner conduit 328*a* is between 20 mm and 40 mm, e.g., between 20 and 30 mm, 25 and 35 mm, 30 mm and 40 mm, etc. The height of the upper inner conduit 328*a* is, for example, 0.5 mm to 2 mm less than the height H4 of the housing 322.

The second vane 332 and the first vane 330 form an angle between, for example, 10 degrees and 40 degrees, e.g., between 10 degrees and 20 degrees, 20 degrees and 30 degrees, 30 degrees and 40 degrees, etc. In some implementations, the inlet duct 326 has a minimum width W2 between 5 and 20 mm, e.g., between 5 and 15 mm, between 10 and 20 mm, etc. The minimum width W2 is between, for example, 5% and 15% of a width of the inlet 114 of the cleaning bin 100, e.g., between 5% and 10%, 10% and 15%, etc., of the width of the inlet 114. The diameter D2 is, for example, between 70% and 95% of the diameter D1, e.g., between 70% and 85%, 75% and 90%, and 80% and 95%, etc., of the diameter D1. By being sized in this manner, abrupt narrowing of the flow area of the airflow 110 between the inlet 114 and the outlet 126 can be minimized, thus decreasing overall power drawn by the vacuum assembly 108.

The upper inner conduit 328*a* is pneumatically connected to the lower inner conduit 328*b* defined by the debris separation cone 122. The debris separation cone 122 defines an upper opening 346 of the lower inner conduit 328*b* and a lower opening 348 of the lower inner conduit 328*b*. The upper opening 346 pneumatically connects the lower inner conduit 328*b* to the upper inner conduit 328*a*. The lower opening 348 connects the lower inner conduit 328*b* to the particulate compartment 128 so that, as described herein, the particulate compartment 128 can receive debris 104 from the debris separator 320.

The debris separation cone 122 has a frustoconical shape. In this regard, the lower inner conduit 328*b* also has a frustoconical shape. A height H5 of the debris separation cone 122 and the upper inner conduit 328*a* is between, for example, 30 mm and 60 mm, e.g., between 30 and 40 mm, 40 mm and 50 mm, 50 mm and 60 mm. In some cases, the height H5 is a percent of the overall height H2 of the debris separator 320. The height H5 is, for example 60% to 90% of the overall height H2 of the debris separator 320, e.g., 60% to 80%, 65% to 85%, 70% to 90% of the overall height H2.

Referring back to FIG. 4B, because the debris separation cone 122 and the lower inner conduit 328*b* have frustoconical shapes, they can be defined by an angle A1 relative to a central axis 336 of the frustoconical shape. The central axis 336 of the lower inner conduit 328*b* corresponds to a central axis of the frustocone, e.g., the debris separation cone 122, defined by the lower inner conduit 328*b*. The angle A1 corresponds to an angle between a slope and the central axis 336 of the debris separation cone 122. The angle A1 is, for example, between 7.5 and 20 degrees, e.g., between 7.5 and 15 degrees, 10 degrees and 17.5 degrees, 12.5 and 20 degrees.

In some examples, a diameter D2 of the lower opening 348 of the lower inner conduit 328*b* is between 5 mm and 20 mm, e.g., between 5 and 10 mm, 10 and 15 mm, 15 and 20 mm, etc. A diameter of the upper opening 346 of the lower inner conduit 328*b* is, for example, equal to the diameter D1 of the upper inner conduit 328*a*. The diameter D2 is, for example, between 10% to 50% of the diameter D1, e.g., between 10% and 30%, 20% and 40%, 30% and 50%, etc., of the diameter D1.

Figure 4B:
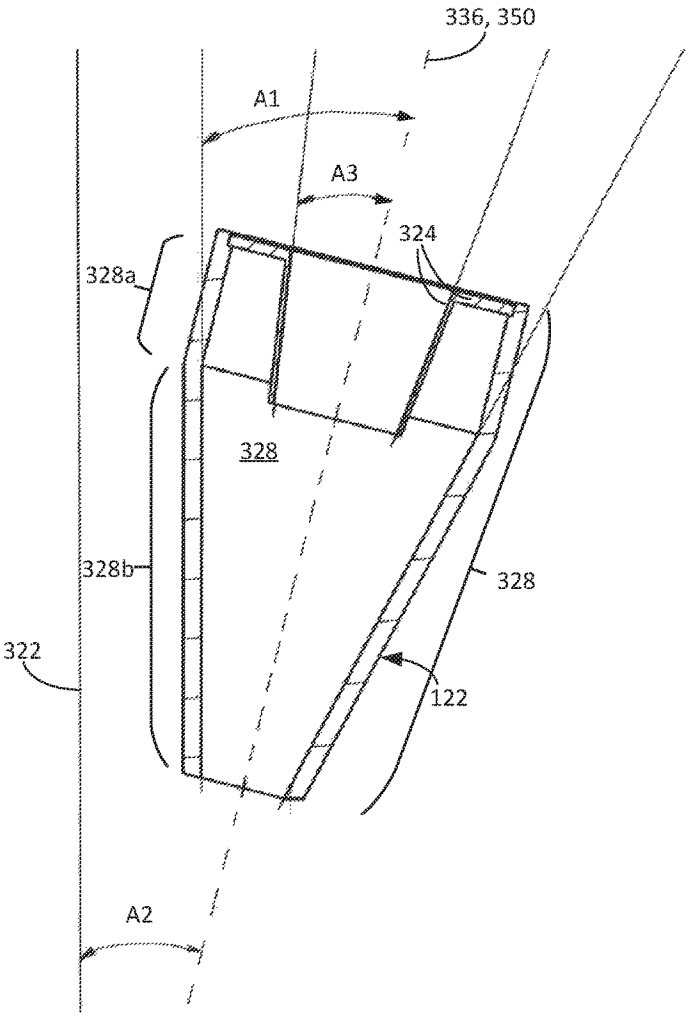

Referring to FIGS. 3B and 4B, in some examples, the debris separator 320 and the debris separation cone 122 are tilted within the cleaning bin 100. In some implementations, a vertical axis 349 through the cleaning bin 100 and the central axis 336 of the debris separation cone 122 form an angle A2 between 0 and 45 degrees, e.g., between 0 and 10 degrees, 5 and 25 degrees, 10 and 40 degrees, 15 and 45 degrees, etc. The vertical axis 349 is, for example, perpendicular to the floor surface 106. In some cases, the vertical axis 349 is parallel to the front side 304 and/or the rear side 306.

In some examples, the central axis 336 is substantially perpendicular to the top surface 118 of the debris compartment 116 and/or the bottom surface of the air channel 120. The central axis and the bottom surface of the air channel 120 form an angle between, for example, 85 degrees and 95 degrees, e.g., between 87 and 93 degrees, 89 and 91 degrees, etc. Because the debris separation cone 122 is tilted relative to the vertical axis 349, a depth of the debris separation cone 122 can be greater without requiring the height H1 of the cleaning bin 100 to increase to accommodate the separation cone 122. As a result, the cleaning bin 100 can still effectively form the cyclone 121 to separate the debris 104 while maintaining a compact height H1.

The vortex finder 324 includes an outlet duct 334 through which the airflow 110 exits the interior volume 328 of the debris separator 320. The outlet duct 334 pneumatically connects the lower inner conduit 328*b* to an outlet channel 340 preceding the filter 124. The upper inner conduit 328*a* is pneumatically connected to the lower inner conduit 328*b*, and the lower inner conduit 328*b* is pneumatically connected to the outlet duct 334. A lower opening 342 of the outlet duct 334 is positioned within the lower inner conduit 328*b*. In this regard, the outlet duct 334 extends through the upper inner conduit 328*a* and terminates within the lower inner conduit 328*b*. Because the debris separator 320 and the debris separation cone 122 are tilted, the airflow 110 directed out of the outlet duct 334 can be less restricted. In particular, the tilt of the debris separator 320 reduces restrictions in the airflow 110 at the outlet duct 334 that could occur if the outlet duct 334 were oriented to direct the airflow vertically out of the debris separator 320.

In some examples, the outlet duct 334 tapers toward the lower inner conduit 328*b*. As shown in FIG. 4B, an inner wall surface of the outlet duct 334 and the central axis 336 of the lower inner conduit 328*b* forms an angle A3 between, for example, 5 and 30 degrees, e.g., between 5 and 20 degrees, 10 and 25 degrees, 15 and 30 degrees, etc. In some cases, both an outer wall surface of the outlet duct 334 and the inner wall surface of the outlet duct 334 form the angle A3 with the central axis 336. The lower opening 342 of the outlet duct 334 has a diameter D3 between 10 mm and 30 mm, e.g., between 10 mm and 20 mm, 20 mm and 30 mm, etc. The diameter D3 is, for example, 25% to 75% of the diameter D1, e.g., between 25% and 50%, 40% and 60%, 50% and 75%, etc., of the diameter D1. An upper opening 344 of the outlet duct 334 has a diameter greater than the diameter D3 of the lower opening 342, e.g., 0.5 to 5 mm greater than the diameter of the lower opening 342. The tapering of the outlet duct 334 can increase the depth of the cyclone 121 formed within the lower inner conduit 328*b*. In particular, during the cleaning operation, the lowermost point of the cyclone 121 can extend farther downward toward the lower opening 348 of the lower inner conduit 328*b*. The tapering of the outlet duct 334 can increase the air path out of the outlet duct 334, thereby reducing constrictions to the airflow 110. In this regard, the tapering of the outlet duct 334 can reduce power consumption by the vacuum assembly 108.

In some example, a length L2 of the outlet duct 334 is sufficient such that the lower opening 342 of the outlet duct 334 is positioned within the lower inner conduit 328*b*. The length L2 is, for example, between 10.5 mm and 30.5 mm, e.g., between 11 mm and 26 mm, 16 mm and 30, etc. The length L2 is, for example, 0.5 mm to 5 mm greater than the height H4 of the housing 322.

Referring to FIG. 3B, the particulate compartment 128 is positioned below the debris separator 320. The particulate compartment 128 is defined by the bottom side 310 of the cleaning bin 100, the lateral sides 302*a*, 302*b* of the cleaning bin 100, a wall 350 of the particulate compartment 128, and a separation wall 352 between the particulate compartment 128 and the debris compartment 116. The wall 350 defines an upper surface of the particulate compartment 128. The particulate compartment 128 has a substantially triangular or a substantially trapezoidal shape. In this regard, the wall 350 is angled relative to the bottom side 310 of the cleaning bin 100. The wall 350, for example, forms an angle with the bottom side 310 of the cleaning bin 100 similar to the angle formed between the bottom surface of the air channel 120 and the top side 308 of the cleaning bin 100.

The separation wall 352 inhibits airflow between the debris compartment 116 and the particulate compartment 128 and hence also inhibits the debris 104 from moving between the compartments 116, 128. The particulate compartment 128 receive smaller sized debris, e.g., particulate, because the larger size debris is separated at the filtering surface 118*a* and is deposited within the debris compartment 116. The particulate compartment 128 typically stores less of the debris 104 than the debris compartment 116. In this regard, the volume of the particulate compartment 128 is between 1 and 10% of the volume of the debris compartment 116, e.g., 1 to 5%, 4 to 8%, and 5% to 10%, etc., of the volume of the debris compartment 116. The volume of the debris compartment 116 is between, for example, 600 and 1000 mL, e.g., between 600 and 800 mL, 700 and 900 mL, 750 mL and 850 mL, 800 mL and 1000 mL, etc. The volume of the particulate compartment is between, for example, 20 mL and 100 mL, e.g., between 20 mL and 50 mL, 30 mL and 70 mL, 40 mL and 60 mL, 45 mL and 55 mL, 60 mL and 100 mL, etc.

The outlet channel 340 preceding the filter 124 is defined by the top side 308 of the cleaning bin 100, the lateral sides 302*a*, 302*b* of the cleaning bin 100, the debris separator 320, the filter 124, and the wall 350 of the particulate compartment 128. The filter 124 is positioned on the rear side 306 of the cleaning bin 100 at the outlet 126 of the cleaning bin 100. In some cases, the filter 124 is removably attached to the rear side 306 of the cleaning bin 100. The filter 124 enables the airflow 110 to pass through the outlet 126 of the cleaning bin 100 and toward the vacuum assembly 108 of the robot 102. In some examples, the filter 124 is a high-efficiency particulate air (HEPA) filter. In some cases, the filter 124 is removable, replaceable, disposable, and/or washable.

In some cases, the outlet 126 spans the entire interior width W1 of the cleaning bin 100. In addition, the filter 124 spans the entire interior width W1 of the cleaning bin 100, and the outlet channel 340 spans the entire interior width W1 of the cleaning bin 100. The outlet 126 spans, for example, 90% to 100% the length of the interior width W1. If the outlet 126 spans the entire interior width W1 of the cleaning bin 100, the rear side 306 of the cleaning bin 100 corresponds to the outlet 126.

While a single debris separator 320 has been described, referring to FIGS. 3A and 3C, in some examples, the debris separator 320 is one of a set of several debris separators 320*a*-320*f*. In the example depicted in FIGS. 3A and 3C, the debris separator 320, 320*a* is one of six debris separators 320*a*-320*f*. In some implementations, fewer or more debris separators 320*a*-320*f* are present within the cleaning bin 100, e.g., 1-5, or 7 or more debris separators. In some implementations, the cleaning bin 100 includes 2 to 16 debris separators, e.g., 2 to 4 debris separators, 4 to 8 debris separators, 4 to 12 debris separators, 4 to 16 debris separators, etc. In some cases, the debris separators 320*a*-320*f* are linearly arranged. The debris separators 320*a*-320*f* are arranged along a horizontal axis 356 through the cleaning bin 100. The horizontal axis 356 is parallel to the front side 304 of the cleaning bin 100. The set of the debris separators 320*a*-320*f* are arranged across the interior width W1 of the cleaning bin 100. The debris separators 320*a*-320*f*, for example, span the entire interior width W1 of the cleaning bin 100. The debris separators 320*a*-320*f* are arranged such that the airflow 110 is directed into each of the debris separators 320*a*-320*f* in the same direction. In particular, portions of the airflow 110 received by the debris separators 320*a*-320*f* are each directed rearwardly toward the rear side 306 of the cleaning bin 100. Similarly, the portions of the airflow 110 exhausted from the debris separators 320*a*-320*f* are directed toward the rear side 306 of the cleaning bin 100.

Each of the debris separators 320*a*-320*f* includes structures and conduits similar to those described with respect to the debris separator 320, e.g., as shown in FIGS. 4A-4C. Inlet ducts 326*a*-326*f* of the debris separators 320*a*-320*f* are each pneumatically connected to the air channel 120 to receive a portion of the airflow 110. The inlet ducts 326*a*-326*f* direct the airflow 110 into the debris separators 320*a*-320*f* in the same direction toward the rear side 306 of the cleaning bin 100, e.g., along parallel axes toward the rear side 306 of the cleaning bin 100. The inlet ducts 326*a*-326*f* can be shaped to funnel air into the debris separators 320*a*-320*f* in a manner that reduces the overall power increase that may be required by the vacuum assembly 108 to draw air into the debris separators 320*a*-320*f* In particular, the flow paths through the inlet ducts 326*a*-326*f* can be shaped to reduce air constrictions along the flow paths. In this regard, even though the inlet ducts 326*a*-326*f* may have a combined width less than a width of the air channel 120, the shapes of the inlet ducts 326*a*-326*f* can reduce the power increase that can be caused by the narrowing of the flow path for the airflow 110 at the inlet ducts 326*a*-326*f*.

Outlet ducts 334*a*-334*f* of the debris separators 320*a*-320*f* are each pneumatically connected to the outlet channel 340. The outlet ducts 334*a*-334*f* direct the airflow 110 from the debris separators 320*a*-320*f* in the same direction both rearwardly toward the rear side 306 of the cleaning bin 100 and upwardly toward the top side 308 of the cleaning bin 100, e.g., along parallel axes rearwardly toward the rear side 306 of the cleaning bin and upwardly toward the rear side 306 of the cleaning bin 100.

The longitudinal axes of the debris separators 320*a*-320*f* are parallel to one another. In some cases, the longitudinal axes of the debris separators 320*a*-320*f*, e.g., the central axes of the debris separation cones of the debris separators 320*a*-320*f*, are coplanar. The longitudinal axes are angled away from the inlet 114 of the cleaning bin 100 such that upper openings of the debris separation cones of the debris separators 320*a*-320*f* are tilted away from the inlet 114. The lower openings of the debris separation cones of the debris separators 320*a*-320*f* are each connected to the particulate compartment 128 to deposit smaller sized debris separated from the airflow 110 in the particulate compartment 128.

In some cases, the debris separators 320*a*, 320*c*, 320*e* differ from the debris separators 320*b*, 320*d*, 320*f* in that the inlet ducts 326*a*, 326*c*, 326*e* are positioned to direct the airflow 110 in a clockwise direction (from the perspective shown in FIG. 3C) within the inner conduits of the debris separators 320*a*, 320*c*, 320*e*. In contrast, the inlet ducts 326*b*, 326*d*, 326*f* are positioned to direct the airflow 110 in a counterclockwise direction (from the perspective shown in FIG. 3C) within the inner conduits of the debris separators 320*b*, 320*d*, 320*f* In some cases, the debris separators 320*a*-320*f* are arranged in pairs such that every inlet duct 326*a*-326*f* is adjacent to one of the other inlet ducts 326*a*-326*f* In this regard, the air channel 120 does not need to include a separate conduit for each of the inlet ducts 326*a*-326*f*. Rather, as shown in FIG. 3C, the air channel 120 includes three separate conduits 354*a*-354*c* to guide the airflow 110 from the air channel 120 into the inlet ducts 326*a*-326*f* In some cases, each clockwise-oriented debris separator 320*a*, 320*c*, 320*e* is positioned between (i) a counterclockwise-oriented debris separator 320*b*, 320*d*, 320*f* and another counterclockwise-oriented debris separator 320*b*, 320*d*, 320*f* or (ii) a counterclockwise-oriented debris separator 320*b*, 320*d*, 320*f* and one of the lateral sides 302*a*, 302*b* of the cleaning bin 100. In addition, each counterclockwise-oriented debris separator 320*b*, 320*d*, 320*f* is positioned between (i) a clockwise-oriented debris separator 320*a*, 320*c*, 320*e* and another clockwise-oriented debris separator 320*a*, 320*c*, 320*e* or (ii) a clockwise-oriented debris separator 320*a*, 320*c*, 320*e* and one of the lateral sides 302*a*, 302*b*.

Figure 5A:
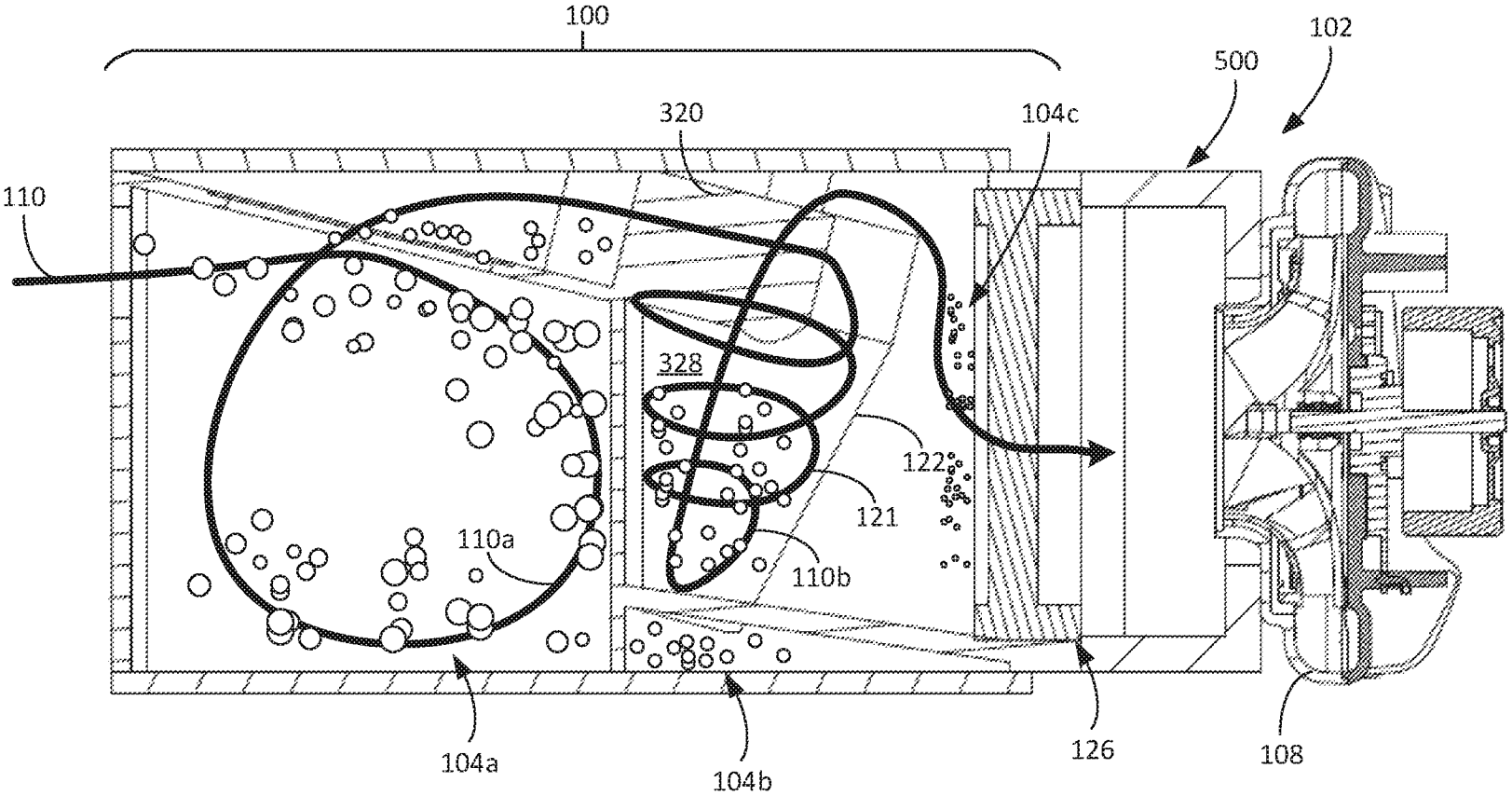
FIG. 5A is a right side cross-sectional view of the cleaning bin of FIG. 3A connected to a vacuum assembly of the autonomous cleaning robot of FIG. 1.

Referring to FIG. 5A, the outlet 126 is configured to be connected to a housing 500 of the vacuum assembly 108 of the robot 102 such that the airflow 110 containing the debris is directed from the inlet 114 to the outlet 126. The housing 500 and the outlet 126 form a sealed engagement when connected to ensure that the airflow 110 generated by the vacuum assembly 108 travels through the cleaning bin 100. Referring back to FIG. 1, during a cleaning operation, the vacuum assembly 108 is operated to draw air from near the cleaning rollers 212*a*, 212*b*, through the cleaning bin 100, and toward the vacuum assembly 108 to form the airflow 110.

The airflow 110 containing the debris 104 is directed through the plenum 112 of the robot 102 and then into the cleaning bin 100 through the inlet 114 of the cleaning bin 100. In particular, the airflow 110 is directed into the debris compartment 116. In some implementations, the inlet 114 directs the airflow 110 into the debris compartment 116 in a manner such that the debris 104 contained within the airflow 110 is directed toward the top surface 118 of the debris compartment 116.

The debris 104 that is too large to pass through the filtering surface 118*a* remains within the debris compartment 116. The filtering surface 118*a* functions as a stage of debris separation that causes separated debris to be retained within the debris compartment 116. A portion 104*a* of the debris 104 that is too large to pass through the filtering surface 118*a* contacts the filtering surface 118*a*. This portion 104*a* of the debris 104 is moved toward a rearward portion of the debris compartment 116 due to the airflow 110 and the downward angle of the top surface 118 of the debris compartment 116 relative to the top side 308 of the cleaning bin 100. In addition, because the airflow 110 is directed tangentially along the filtering surface 118*a* as it travels through the air channel 120, the airflow 110 shears the portion 104*a* of the debris 104 that accumulates along the filtering surface 118*a*. In some implementations, the airflow 110 moves the debris 104 that has accumulated along the filtering surface 118*a* toward the blocking surface 118*b*. When the debris 104 reaches the blocking surface 118*b*, the debris 104 is separated from the filtering surface 118*a* and is thereby separated from the airflow 110. The debris 104 then falls into the debris compartment 116. The shearing of the debris 104 can thereby preventing the debris 104 from blocking the filtering surface 118*a* and impeding the airflow 110 through the filtering surface 118*a*. This portion 104*a* of the debris 104 is then directed toward the dead zone 318 of the debris compartment 116, thereby separating from the filtering surface 118*a* and dropping within the debris compartment 116, e.g., due to gravity. The debris compartment 116 stores this separated portion 104*a* of the debris 104 during the cleaning operation.

In some cases, the portion 104*a* of the debris 104 stored in the debris compartment 116 corresponds to debris separated from the airflow 110 during multiple stages. Alternatively or additionally, the debris compartment 116 functions as a stage of debris separation in which debris 104 that is too heavy to travel with the airflow 110 falls toward the bottom of the debris compartment 116 due to the force of gravity. In some examples, the filtering surface 118*a* functions as another stage of debris separation, as described herein. The debris compartment 116 receives the debris 104 separated from the airflow 110 during both of these stages of debris separation.

The portion 104*a* of the debris 104 that is separated from the airflow 110 is distinct from the portion 104*b* that is separated from the airflow 110 through the cyclone 121, as described herein. In particular, the portion 104*a* of the debris 104 is separated through a portion 110*a* of the airflow 110 that is non-cyclonic. The portion 110*a* of the airflow 110 that travels through the debris compartment 116, for example, travels along a loop across the top surface 118, along the rear surface of the debris compartment 116, along the bottom surface of the debris compartment 116, along the front surface of the debris compartment 116, and then through the top surface 118. In some examples, some of the portion 110*a* of the airflow 110 travels directly from the inlet 114, through the debris compartment 116, and then through the top surface 118 of the debris compartment 116. The portion 110*a* of the airflow 110 does not form a cyclone. In this regard, the debris compartment 116 separates the portion 104*a* from the airflow 110 absent a cyclone being formed.

After the airflow 110 travels through the debris compartment 116, the airflow 110 is directed out of the debris compartment 116 through the filtering surface 118*a*. The airflow 110 is then directed through the air channel 120, which directs the airflow 110 toward the debris separators 320*a*-320*f*. The airflow 110 forms a cyclone, e.g., the cyclone 121, in each of the debris separators 320*a*-320*f*. FIG. 5A shows a single debris separator 320 in which the cyclone 121 is formed. The debris separator 320 receives a portion 110*b* of the airflow 110 and causes the portion 110*b* of the airflow 110 to form the cyclone 121. In particular, the portion 110*b* of the airflow 110 rotates about the interior volume 328 of the debris separator 320. As the portion 110*b* of the airflow 110 continues to rotate about the interior volume 328, the diameter of the path followed by the portion 110*b* of the airflow 110 decreases. The path, for example, includes multiple substantially circular loops, and the circular loops are decreasing in diameter toward the bottom of the interior volume 328. In this regard, the portion 110*b* of the airflow 110 forms the cyclone 121. While a single cyclone 121 is depicted, each of the debris separators 320*a*-320*f* receives a distinct portion of the airflow 110 and causes the corresponding portion of the airflow 110 to form a cyclone distinct from the cyclones formed by the other debris separators 320*a*-320*f*.

The debris separators 320*a*-320*f* serve as another stage of debris separation that separates a portion 104*b* of debris 104 and deposits the portion 104*b* in the particulate compartment 128. Because the filtering surface 118*a* separates the portion 104*a* of the debris 104 from the airflow 110 before the airflow 110 reaches the debris separators 320*a*-320*f*, the debris 104 that reaches the airflow 110 can tend to be smaller. The filtering surface 118*a* also can separate fibrous or filament debris from the airflow 110. This can reduce the likelihood that large debris or filament debris becomes stuck in the relatively small space within the debris separators 320*a*-320*f*. In some implementation, as described with respect to the debris separator 320 in FIGS. 4A-4C, the airflow 110 is directed through the inlet duct 326 of the debris separator 320 and into the interior volume 328. In particular, the airflow 110 is directed into the upper inner conduit 328*a*. In some cases, the debris 104 contained in the airflow 110 directed into the upper inner conduit 328*a* strikes an outer surface of the vortex finder 324 as the debris 104 enters into the upper inner conduit 328*a*. As a result, the debris 104 loses velocity and begins to fall downward toward the lower inner conduit 328*b*.

In addition, because the upper inner conduit 328*a* is pneumatically connected to the lower inner conduit 328*b*, the airflow 110 containing the debris 104 is also directed from the upper inner conduit 328*a* toward the lower inner conduit 328*b*. When the airflow 110 travels through the interior volume 328, the airflow 110 forms the cyclone 121. The vortex finder 324 facilitates formation of the cyclone 121 as the airflow travels through the upper inner conduit 328*a*. The conical shape of the lower inner conduit 328*b* further facilitates formation of the cyclone 121 as the airflow 110 flows through the lower inner conduit 328*b*. The cyclone 121 extends through at least a portion of the lower inner conduit 328*b*.

The vacuum assembly 108 tends to draw the airflow 110 through the outlet duct 334 at the top of the debris separator 320, thereby applying a vacuum force counter to the downward flow direction of the cyclone 121. In some implementations, the vacuum force creates a lower pressure zone toward a central portion of the debris separator 320, causing the airflow 110 to move rapidly around the lower pressure zone in the form of the cyclone 121. The debris 104 contained in the airflow 110 contacts the wall of the lower inner conduit 328*b*, causing the debris 104 to slow down relative to the airflow 110 and migrate downward along the sloped surface of the wall of the lower inner conduit 328*b*. The friction between the debris 104 and the wall can further reduce the velocity of the debris 104. Due to gravity, the debris 104 is forced downward toward the particulate compartment 128. In this regard, the portion 104*b* of the debris 104 is separated from the airflow 110 due to the cyclone 121 formed in the debris separator 320. The lower opening 348 is positioned relative to the particulate compartment 128 such that the particulate compartment 128 receives the debris 104 that travels through the lower inner conduit 328*b*. The debris 104 that separates from the airflow 110 is forced by gravity through the lower inner conduit 328*b* toward the lower opening 348 and into the particulate compartment 128.

While described with respect to the debris separator 320, the flow dynamics are applicable to each of the debris separators 320*a*-320*f*. In particular, the debris separators 320*a*-320*f* each receive a portion of the airflow 110 to form a cyclone within their respective inner conduits. Each of the debris separators 320*a*-320*f* separates a portion of the ingested debris 104 from the airflow 110 and deposits the separated debris into the particulate compartment 128.

The airflow 110, proceeding the cyclones formed by the debris separators 320*a*-320*f*, is drawn through the outlet ducts of the debris separators 320*a*-320*f*. Because the envelope of the cleaning bin 100 is short, e.g., the height H1 is short, the debris separators 320*a*-320*f* are tilted such that the portions of the airflow 110 out of the debris separators 320*a*-320*f* through the outlet ducts are less constricted. The portions of the airflow 110 from the debris separators 320*a*-320*f* are recombined in the outlet channel 340. The combined airflow 110 is drawn through the outlet channel 340, which directs the airflow 110 through the outlet 126 and the filter 124. The filter 124 serves as an additional stage of debris separation for the cleaning bin 100. The filter 124 separates debris 104 from the airflow 110 larger than a predetermined size, e.g., debris 104 having a width larger than between about 0.1 and about 0.5 micrometers. In some cases, the vacuum assembly 108 then exhausts the airflow 110 into the environment of the robot 102 through the vent 213. In other examples, the airflow 110 is exhausted to the cleaning head to increase agitation of debris on the floor surface 106.

In this regard, in one specific example, the cleaning bin 100 facilitates separation of debris 104 in four distinct stages. Separation of debris 104 from the airflow 110 facilitated by gravity is the first stage of separation. Separation of debris 104 from the airflow 110 facilitated by the filtering surface 118*a* is the second stage of separation. Separation of debris 104 from the airflow 110 facilitated by the debris separation cone 122 is the third stage of separation. Separation of debris 104 from the airflow 110 facilitated by the filter 124 is the fourth stage of separation.

After the cleaning operation, the debris 104 that remains within the debris compartment 116 corresponds to a first portion 104*a* of the debris 104 that is deposited within the cleaning bin 100. A second portion 104*b* of the debris 104 is deposited within the particulate compartment 128, and a third portion 104*c* of the debris 104 is deposited at the filter 124 at the outlet 126 of the cleaning bin 100. The airflow 110 is then directed through an inlet 114 of the cleaning bin 100, through a debris compartment 116, through a top surface 118 of the debris compartment 116, into an air channel 120, through a debris separation cone 122, and then through a filter 124 at an outlet 126 of the cleaning bin 100. Whereas the debris 104 in the debris compartment 116 includes generally larger debris, e.g., having a width of 100 microns to 500 microns or larger, the debris 104 in the particulate compartment 128 includes smaller debris having a width of 100 microns to 500 microns or smaller.

Figure 5B:
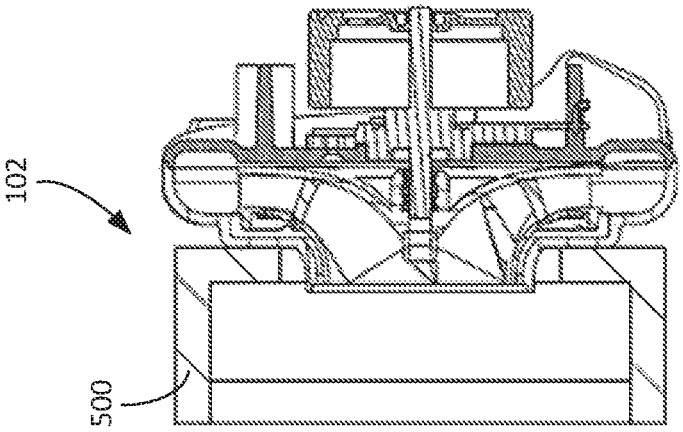
FIG. 5B is a right side cross-sectional view of the cleaning bin of FIG. 5A disconnected from a vacuum assembly of the autonomous cleaning robot of FIG. 1 and with a door in an open position.
Figure 5B:
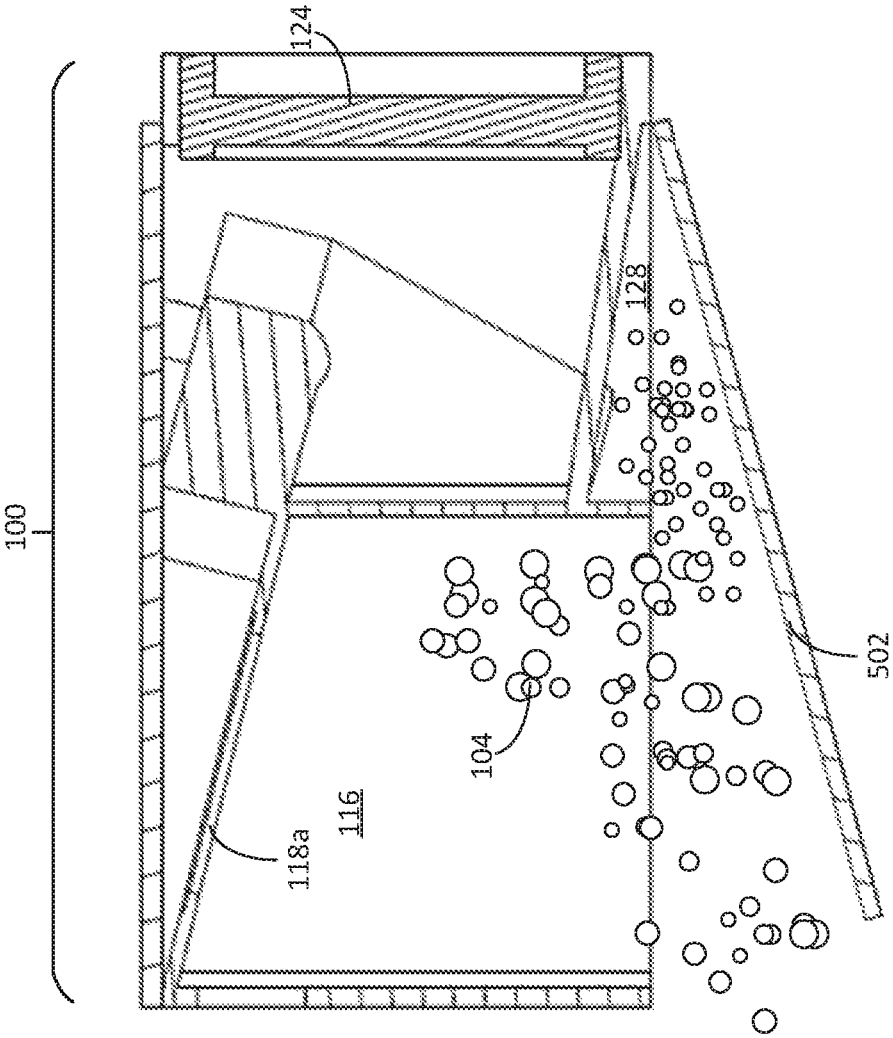

In some implementations, the cleaning bin 100 is removably mounted to the body 200 of the robot 102 and is removed from the robot 102 after the cleaning operation. In particular, referring to FIG. 5B, the cleaning bin 100 is disconnected from the housing 500 of the vacuum assembly 108 to enable removal of the debris 104 stored within the cleaning bin 100. The vacuum assembly 108 is, for example, part of the robot 102. In some cases, the housing and the vacuum assembly 108 are attached to the cleaning bin 100, and the cleaning bin 100, the vacuum assembly 108, and the housing 500 are removed as a unit to enable removal of the debris 104 from the cleaning bin 100. In some cases, debris removed from the cleaning bin 100 when the cleaning bin 100 is still mounted to the body 200 of the robot 102. The bottom side 310 of the cleaning bin 100 includes a door 502 that defines the bottom surface of the debris compartment 116 and the bottom surface of the particulate compartment 128. The door 502, when opened, enables the debris 104 in both the debris compartment 116 and the particulate compartment 128 to be removed from the cleaning bin 100. such that the door 502. The door 502 is rotatably attached to the cleaning bin 100. A user manually rotates the door 502 away from the compartments 116, 128 to enable the debris 104 to be emptied from the compartments 116, 128. Alternatively, the door 502 is slidably attached to the cleaning bin 100, or is attached in some other manner that enables the door 502 to be manually opened to access the debris 104 in both the debris compartment 116 and the particulate compartment 128.

In some cases, in addition to emptying the contents of the debris compartment 116 and the particulate compartment 128, the user removes the cleaning bin 100 from the robot 102, and then removes the filter 124 from the cleaning bin 100. The user then cleans the filter 124 and repositions the filter 124 in the cleaning bin 100. In some cases, the user disposes of the filter 124 and repositions a new filter in the cleaning bin 100. In some cases, the filtering surface 118*a* is removed, cleaned, and repositioned, or the filtering surface 118*a* is disposed and replaced with a new filtering surface.

Figure 6:
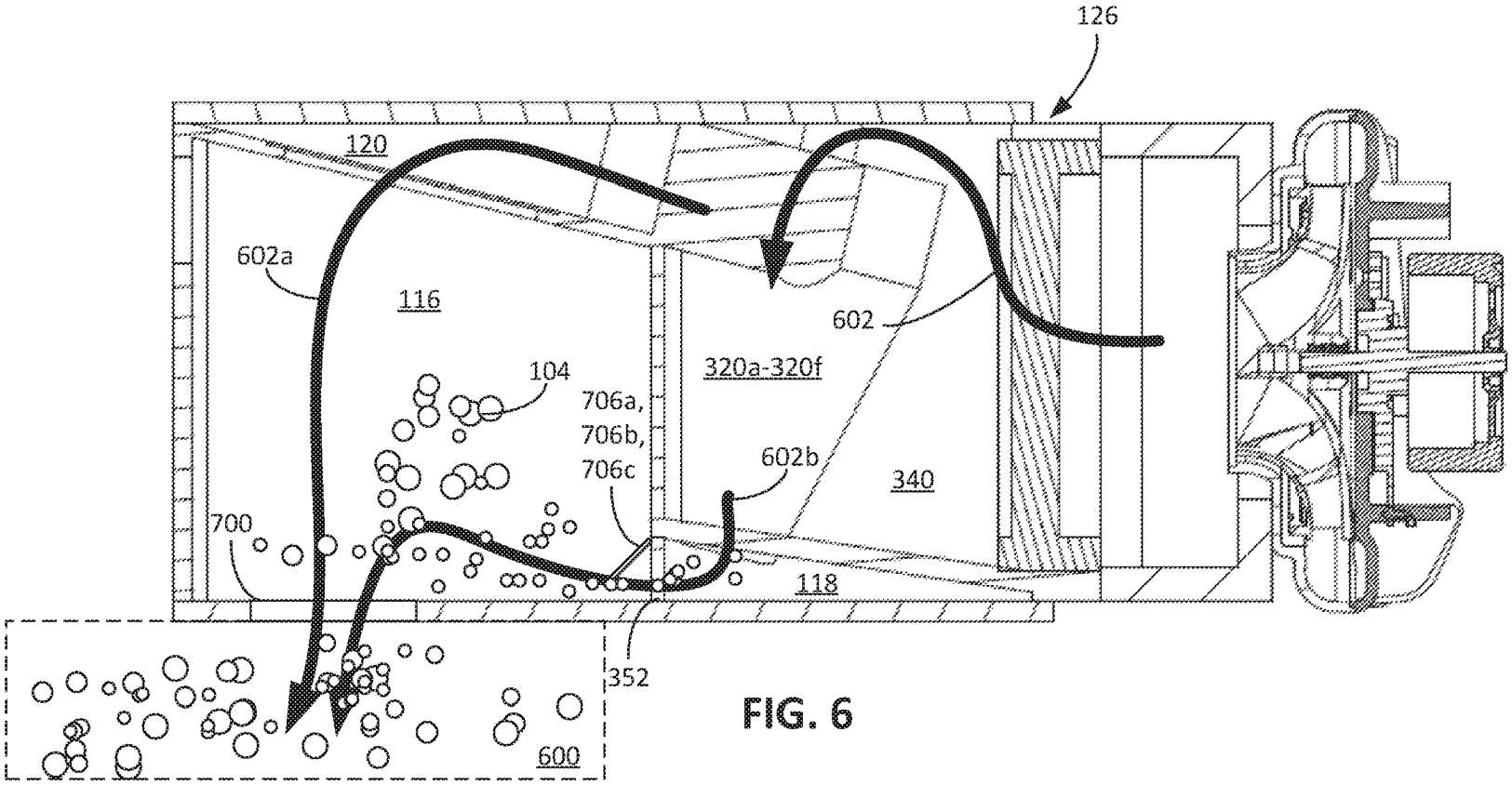
FIG. 6 is right side cross-sectional view of the cleaning bin of FIG. 3A when the autonomous cleaning robot carrying the cleaning bin is docked at an evacuation station.

In some implementations, after the cleaning operation, the robot 102 is docked at an evacuation station 600 (schematically shown in FIG. 6) that includes a vacuum assembly. The evacuation station 600 performs an evacuation operation in which the vacuum assembly is operated to generate an airflow 602 through the cleaning bin 100 toward the evacuation station 600. FIG. 6 shows the vacuum assembly 108 of the robot 102 for context but does not show the other components of the robot 102 for simplicity. Furthermore, the evacuation station 600 is schematically depicted. Examples of evacuation stations to which the robot 102 is capable of docking are described with respect to U.S. Pat. No. 9,462,920, issued on Oct. 11, 2016, and titled "Evacuation Station," the contents of which are incorporated herein by reference in its entirety.

During the evacuation operation, the airflow 602 directs the debris 104 within the cleaning bin 100 toward the evacuation station 600. The evacuation station 600, for example, forms a seal with the cleaning rollers 212*a*, 212*b* such that the vacuum assembly of the evacuation station 600, when operated, draws air through the vent 213 of the robot 102, thereby generating the airflow 602 shown in FIG. 6. The airflow 602 carries the debris 104 contained within the debris compartment 116 and the particulate compartment 128 into the evacuation station 600. In this regard, the user does not need to manually empty the debris 104 from the cleaning bin 100.

Figure 7:
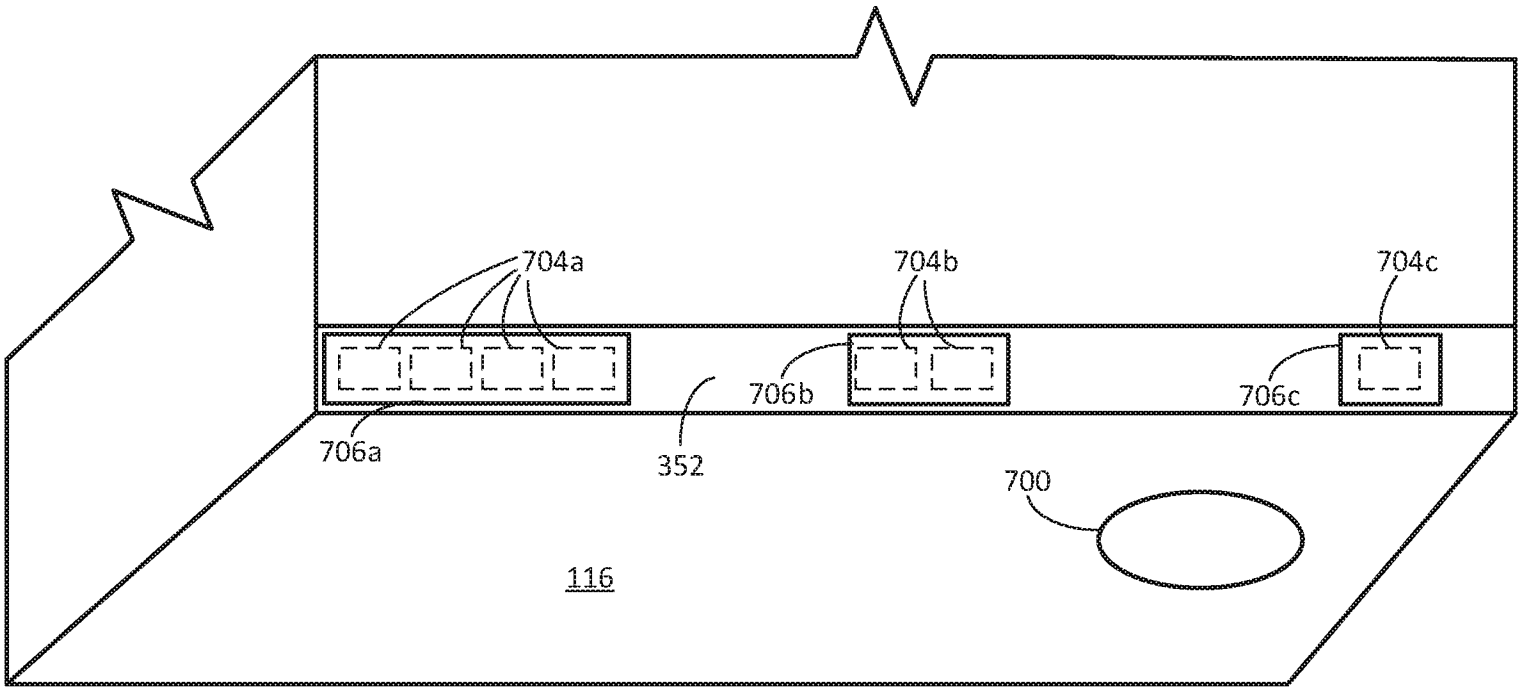
FIG. 7 is a front perspective cutaway view of a debris compartment of the cleaning bin of FIG. 3A with a front side and a lateral side of the cleaning bin removed.

FIG. 7 depicts a cutaway perspective view of the debris compartment 116 with the lateral side 302*b* and the front side 304 of the cleaning bin 100 removed so that the inside of the debris compartment 116 is visible. To enable air to be drawn by the vacuum assembly of the evacuation station 600, the cleaning bin 100 includes an evacuation port 700 configured to connect to the vacuum assembly of the evacuation station 600. The vacuum assembly of the evacuation station 600 is operable to direct the airflow 602 from the outlet 126 of the cleaning bin 100 to the evacuation port 700. The airflow 602 is directed from the environment through the vent 213, through the outlet 126, through the outlet channel 340, and into the debris separators 320*a*-320*f*. A portion 602*a* of the airflow 602 from the debris separators 320*a*-320*f* is directed through the air channel 120, and then through the top surface 118 of the debris compartment 116 into the debris compartment 116. In some cases, the portion 602*a* of the airflow 110 carries debris within the debris compartment 116 at the filtering surface 118*a* toward the evacuation port 700, thereby reducing debris accumulation that may impede airflow through the filtering surface 118*a*. Another portion 602*b* of the airflow 602 from the debris separators 320*a*-320*f*, as described herein, is directed through the particulate compartment 128, and then through the separation wall 352 into the debris compartment 116. The portion 602*b* of the airflow 602 carries the portion 104*b* of the debris 104 in the particulate compartment 128 toward the evacuation port 700. The portions 602*a*, 602*b* are recombined in the debris compartment 116 and then directed through the evacuation port 700 into the evacuation station 600.

To enable the particulate compartment 128 to be evacuated by the evacuation station 600, the separation wall 352 includes open area 704*a*, open area 704*b*, and open area 704*c* between the debris compartment 116 and the particulate compartment 128. The open areas 704*a*, 704*b*, 704*c* pneumatically connect the debris compartment 116 and the particulate compartment 128. As depicted in FIG. 7, the open area 704*a* corresponds to a set of discontinuous open areas between the particulate compartment 128 and the debris compartment 116. In other cases, the open areas 704*a*, 704*b*, 704*c* are each a single continuous open area discontinuous from the other open areas 704*a*, 704*b*, 704*c*. In other implementations, fewer or more open areas are present along the separation wall 352.

The open areas 704*a*, 704*b*, 704*c* are covered by openable flaps 706*a*, 706*b*, 706*c*. The flaps 706*a*, 706*b*, 706*c* are configured to open when a pressure on a side of the flaps 706*a*, 706*b*, 706*c* facing the debris compartment 116 is less than a pressure on a side of the flaps 706*a*, 706*b*, 706*c* facing the particulate compartment 128. In some implementations, top portions of the flaps 706*a*, 706*b*, 706*c* are secured to the separation wall 352, e.g., adhered to the separation wall 352, while bottom portions of the flaps 706*a*, 706*b*, 706*c* are loose and movable away from the separation wall 352 under the above-noted pressure conditions. The flaps 706*a*, 706*b*, 706*c* are formed of a deformable and resilient material. The flaps 706*a*, 706*b*, 706*c* deform into an open position in response to the presence of the higher pressure on the side of the flaps 706*a*, 706*b*, 706*c* facing the particulate compartment 128. When the higher pressure is released and the pressure on either side is equalized, the flaps 706*a*, 706*b*, 706*c* resiliently return to a closed position.

In some cases, the open areas 704*a*, 704*b*, 704*c* positioned farther from the evacuation port 700 are larger than the open areas 704*a*, 704*b*, 704*c* positioned closer to the evacuation port 700. The open area 704*a* is, for example, larger than the open area 704*b*, which is larger than the open area 704*c*. The open area 704*a* is positioned farther from the evacuation port 700 than the open area 704*b*, and the open area 704*b* is positioned from farther from the evacuation port 700 than the open area 704*c*. Accordingly, the flap 706*a* is longer than the flap 706*b*, and the flap 706*b* is longer than the flap 706*c*. Relative sizes of the open areas 704*a*, 704*b*, 704*c* and relative distances to the evacuation port 700 determine the relative portion of the airflow 602 that flows through each of the open areas 704*a*, 704*b*, 704*c*. As a result, the relative sizes and relative distances can be selected such that a similar amount of the airflow 602 flows through each of the open areas 704*a*, 704*b*, 704*c*, enabling the debris 104 from the particulate compartment 128 and the debris compartment 116 to be more uniformly evacuated into the evacuation station 600. In particular, by increasing the size of the open area 704*a* farthest from the evacuation port 700, the debris 104 located at portions of the particulate compartment 128 and the debris compartment 116 farthest from the evacuation port 700 can be more easily evacuated from the cleaning bin 100 during the evacuation operation. The multiple entry points of the airflow 602 into the debris compartment 116 from the particulate compartment 128 can facilitate a swirling motion of the combined airflow 602 in the debris compartment 116, thereby agitating debris 104 and improving evacuation of debris 104 from the debris compartment 116.

When the flaps 706*a*, 706*b*, 706*c* are in the open position (as shown in FIG. 6), the debris compartment and the particulate compartment 128 are pneumatically connected. As a result, the airflow 602 containing debris 104 is allowed to flow between the debris compartment 116 and the particulate compartment 128. In particular, the portion 602*b* of the airflow 602 flows through the debris separators 320*a*-320*f*, into the particulate compartment 128, and then into the debris compartment 116, thereby enabling the evacuation station 600 to evacuate the debris 104 from the particulate compartment 128. When the evacuation station 600 performs the evacuation operation to cause the vacuum assembly to generate the airflow 602, the operation of the vacuum assembly decreases the pressure at the side of the flaps 706*a*, 706*b*, 706*c* facing the debris compartment 116, thereby causing the flaps 706*a*, 706*b*, 706*c* to deform into the open position.

When the flaps 706*a*, 706*b*, 706*c* are in the closed position (as shown in FIG. 7), the open areas 704*a*, 704*b*, 704*c* do not pneumatically connect the debris compartment 116 and the particulate compartment 128. As a result, air cannot flow directly from the particulate compartment 128 to the debris compartment 116 through the open areas 704*a*, 704*b*, 704*c*. When the vacuum assembly 108 of the robot 102 is operating during the cleaning operation, the pressure at the side of the flaps 706*a*, 706*b*, 706*c* facing the debris compartment 116 is greater than the pressure at the side of the flaps 706*a*, 706*b*, 706*c*, thereby causing the flaps 706*a*, 706*b*, 706*c* to remain in the closed position. As a result, the debris 104 deposited into the debris compartment 116 and the debris 104 deposited into the particulate compartment 128 remain in their respective compartments during the cleaning operation.

A number of implementations have been described. Nevertheless, it will be understood that various modifications may be made. Accordingly, other implementations are within the scope of the claims.

What is claimed is:

1. A cleaning bin mountable to an autonomous cleaning robot operable to receive debris from a floor surface, the cleaning bin comprising:

a front side extending along a vertical axis;

an inlet positioned along the front side and between lateral sides of the cleaning bin, the lateral sides defining an interior width of the cleaning bin therebetween;

an outlet configured to connect to a vacuum generator, the vacuum generator operable to direct an airflow from the inlet of the cleaning bin to the outlet of the cleaning bin;

a debris compartment to receive a first portion of debris separated from the airflow;

an air channel positioned above the debris compartment and defined by a top surface of the debris compartment, the top surface of the debris compartment comprising a planar portion being tilted relative to a horizontal axis perpendicular to the vertical axis such that a rear of the planar portion is closer than a front of the planar portion is to a bottom surface of the debris compartment, and the air channel spanning the interior width of the cleaning bin and receiving the airflow from the debris compartment through the top surface of the debris compartment;

a particulate compartment to receive a second portion of debris separated from the airflow; and a debris separator comprising a debris separation cone having an inner conduit defining an upper opening and a lower opening, the upper opening receiving the airflow from the air channel, and the inner conduit tapering from the upper opening to the lower opening such that the airflow forms a cyclone within the inner conduit, wherein a longitudinal axis of the debris separation cone forms a non-zero angle with the vertical axis such that an inlet duct of the debris separator faces toward the air channel and the inlet of the cleaning bin, and such that an outlet duct of the debris separator is tilted toward the outlet.

2. The cleaning bin of claim 1, wherein the inlet spans a length between 75% and 100% of the interior width of the cleaning bin.

3. The cleaning bin of claim 1, wherein the top surface of the debris compartment includes a first filter.

4. The cleaning bin of claim 3, wherein the first filter is sized to inhibit debris having a width between 100 and 500 microns from passing into the air channel.

5. The cleaning bin of claim 3, wherein the non-zero angle is a first angle, and wherein a filtering surface of the first filter and the horizontal axis form a second angle between 5 and 45 degrees.

6. The cleaning bin of claim 1, wherein the non-zero angle is a first angle, and wherein the top surface of the debris compartment and the longitudinal axis of the debris separation cone define a second angle between 85 and 95 degrees, wherein the top surface of the debris compartment slopes downward toward the debris separation cone.

7. The cleaning bin of claim 1, wherein the air channel spans a length between 95% and 100% of the interior width of the cleaning bin.

8. The cleaning bin of claim 1, further comprising:

an evacuation port configured to connect to another vacuum generator operable to direct an airflow from the outlet to the evacuation port; and a first flap covering a first open area pneumatically connected the debris compartment and the particulate compartment, the first flap configured to open when a pressure on a side of the first flap facing the debris compartment is less than a pressure on a side of the first flap facing the particulate compartment.

9. The cleaning bin of claim 8, further comprising a second flap covering a second open area between the debris compartment and the particulate compartment, wherein the first open area is larger than the second open area, and the first flap is positioned farther from the evacuation port than the second flap.

10. The cleaning bin of claim 1, wherein the non-zero angle is a first angle, and wherein the longitudinal axis of the debris separation cone defines a second angle with the vertical axis between 5 and 25 degrees such that the upper opening the debris separation cone is tilted away from the inlet of the cleaning bin.

11. The cleaning bin of claim 1, wherein the non-zero angle is a first angle, and wherein the inner conduit is a conical structure defining a slope that forms a second angle with the longitudinal axis of the debris separation cone, the second angle being between 15 and 40 degrees.

12. The cleaning bin of claim 1, wherein a diameter of the upper opening of the inner conduit is between 20 and 40 millimeters, and a diameter of the lower opening of the inner conduit is between 5 and 20 millimeters.

13. The cleaning bin of claim 1, wherein:

the debris separation cone is a first debris separation cone, and the inner conduit is a first inner conduit, the upper opening is a first upper opening, the lower opening is a first lower opening, and the cyclone is a first cyclone, wherein the first inner conduit receives a first portion of the airflow, and the cleaning bin comprises a second debris separation cone adjacent the first debris separation cone, the second debris separation cone having a second inner conduit defining a second upper opening and a second lower opening, the second upper opening receiving a second portion of the airflow from the air channel, and the second inner conduit tapering from the second upper opening to the second lower opening such that the second portion of the airflow forms a second cyclone within the second inner conduit.

14. The cleaning bin of claim 1, wherein the debris separation cone is one of a set of debris separation cones having longitudinal axes comprising the longitudinal axis of the debris separation cone, wherein the set of debris separation cones is arranged linearly, and the longitudinal axes are coplanar and angled away from the inlet such that upper openings of the set of debris separation cones are tilted away from the inlet.

15. The cleaning bin of claim 1, wherein the top surface of the debris compartment includes a first filter, and the cleaning bin further comprises a second filter positioned between the debris separation cone and the outlet.

16. The cleaning bin of claim 1, wherein the outlet spans the interior width of the cleaning bin.

17. The cleaning bin of claim 1, wherein the inlet duct is pneumatically connected to the air channel, and is pneumatically connected to the inner conduit of the debris separation cone, and wherein the inlet duct comprises a minimum width that is between 5% and 15% of a width of the inlet.

18. The cleaning bin of claim 1, wherein the outlet duct directs the airflow from the inner conduit of the debris separation cone toward the outlet, the outlet duct being tapered toward the inner conduit of the debris separation cone.

19. The cleaning bin of claim 1, further comprising a door defining the bottom surface of the debris compartment and a bottom surface of the particulate compartment, wherein the door is configured to be manually opened to enable the first portion of debris in the debris compartment and the second portion of debris in the particulate compartment to be removed from the cleaning bin.

20. The cleaning bin of claim 1, wherein a maximum height of the cleaning bin is less than 80 millimeters.

21. The cleaning bin of claim 1, wherein the front side of the cleaning bin defines a front surface of the debris compartment.

22. An autonomous cleaning robot comprising:

a body;

a drive operable to move the body across a floor surface;

a vacuum generator carried in the body, the vacuum generator operable to generate an airflow to carry debris from the floor surface as the body moves across the floor surface; and a cleaning bin mounted to the body, the cleaning bin comprising a front side extending along a vertical axis, an inlet positioned along the front side and between lateral sides of the cleaning bin, the lateral sides defining an interior width of the cleaning bin therebetween, an outlet connected to the vacuum generator such that the airflow containing the debris is directed from the inlet to the outlet, a debris compartment to receive a first portion of the debris separated from the airflow, an air channel positioned above the debris compartment and defined by a top surface of the debris compartment, the top surface of the debris compartment comprising a planar portion being tilted relative to a horizontal axis perpendicular to the vertical axis such that a rear of the planar portion is closer than a front of the planar portion is to a bottom surface of the cleaning bin, and the air channel spanning the interior width of the cleaning bin and receiving the airflow from the debris compartment through the top surface of the debris compartment, a particulate compartment to receive a second portion of the debris separated from the airflow, and a debris separator comprising a debris separation cone configured to receive the airflow from the debris compartment to form a cyclone that separates the second portion of the debris from the airflow and directs the second portion of the debris toward the particulate compartment, wherein a longitudinal axis of the debris separation cone forms a non-zero angle with the vertical axis such that an inlet duct of the debris separator faces toward the inlet of the cleaning bin, and such that an outlet duct of the debris separator is tilted toward the outlet.

23. The robot of claim 22, further comprising a cleaning roller rotatably mounted to the body, the cleaning roller configured to engage the debris to move the debris toward the inlet of the cleaning bin, wherein the inlet of the cleaning bin spans a length between 60% and 100% of a length of the cleaning roller.

* * * * *